US007044088B2

(12) United States Patent
Aketa et al.

(10) Patent No.: US 7,044,088 B2
(45) Date of Patent: May 16, 2006

(54) MULTI-CYLINDER ENGINE AND A METHOD FOR ALTERNATIVELY PRODUCING MULTI-CYLINDER ENGINES

(75) Inventors: Masahiro Aketa, Sakai (JP); Wataru Iwanaga, Sakai (JP); Hiroyuki Anami, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 10/799,233

(22) Filed: Mar. 12, 2004

(65) Prior Publication Data

US 2004/0187807 A1 Sep. 30, 2004

(30) Foreign Application Priority Data

Mar. 24, 2003 (JP) ..... P 2003-080349
Oct. 29, 2003 (JP) ..... P 2003-368439

(51) Int. Cl.
*F01P 5/10* (2006.01)
*F02F 1/14* (2006.01)
*F02F 1/20* (2006.01)

(52) U.S. Cl. ..... 123/41.18; 123/41.44; 123/41.74; 123/DIG. 1

(58) Field of Classification Search ..... 123/41.18, 123/41.44, 41.45, 41.46, 41.47, 41.74, DIG. 1, 123/DIG. 7
See application file for complete search history.

(56) References Cited

U.S. PATENT DOCUMENTS 2,179,709 A * 11/1939 Brecht ..... 123/195 A
2,853,063 A * 9/1958 Leach ..... 123/DIG. 1
3,889,644 A 6/1975 Moore
4,665,867 A * 5/1987 Iwamoto et al. ..... 123/41.74
5,078,106 A 1/1992 Matsuo et al.
2003/0056738 A1* 3/2003 Aketa et al. ..... 123/41.74

FOREIGN PATENT DOCUMENTS

| | | |
|---|---|---|
| DE | 12 20 203 B | 6/1966 |
| EP | 1 079 092 A2 | 2/2001 |
| EP | 1 234 973 A1 | 8/2002 |
| JP | 60-190646 A | 9/1985 |
| JP | 10-077902 A | 3/1998 |
| JP | 10-159563 A | 6/1998 |
| JP | 11-107852 A | 4/1999 |
| JP | 2003-83079 A | 3/2003 |
| JP | 2003-097267 A | 4/2003 |
| JP | 2003-097347 A | 4/2003 |
| JP | 2003-097348 A | 4/2003 |

* cited by examiner

*Primary Examiner*—Andrew M. Dolinar
(74) *Attorney, Agent, or Firm*—Akin Gump Strauss Hauer & Feld, LLP

(57) ABSTRACT

A multi-cylinder engine comprises a cylinder block (1) provided with a side water passage (3) oriented in a front and rear direction and passing by each of cylinder walls 12 so as to introduce cooling water from a radiator into a cylinder jacket 4 laterally through the side water passage (3). The side water passage (3) has front and rear end portions provided with front and rear openings (3*a*), (3*b*) which communicate the side water passage (3) with a water pump (10). Thus even if the water pump (10) is arranged at either of the front and rear end portions, the opening of the side water passage 3 near the end portion where the water pump (10) is arranged can communicate the side water passage (3) with the water pump (10).

And a method for alternatively producing multi-cylinder engines, uses the cylinder block (1) as a common part.

17 Claims, 16 Drawing Sheets

MULTI-CYLINDER ENGINE AND A METHOD FOR ALTERNATIVELY PRODUCING MULTI-CYLINDER ENGINES

BACKGROUND OF THE INVENTION

1. Field of the Invention

The present invention concerns a multi-cylinder engine and a method for alternatively producing multi-cylinder engines.

2. Earlier Technology

There is a conventional example of the multi-cylinder engine as shown in FIG. 16 (for example, see Patent Document 1).

Like the present invention, on the assumption that a longitudinal direction of a cylinder block 101 is taken as a front and rear direction, this conventional technique provides in the cylinder block 101, a consecutive side water passage 103 oriented in the front and rear direction and passing by each of cylinder walls 112 and introduces cooling water from a radiator to a cylinder jacket 104 laterally via the side water passage 103.

However, this conventional technique is different from the present invention on the following points.

The conventional technique provides only at a font end portion of the side water passage 103, an opening 103*a* which communicates the side water passage 103 with a water pump 110, but it does not arrange such an opening at a rear end thereof.

The side water passage 103 has an outer wall opened in the front and rear direction to provide a plurality of holes. Although the Patent Document 1 does not explain for what purpose the holes are provided, it is considered that those holes are in an attempt to remove the core sand intended for forming the side water passage after having cast the cylinder block 101.

Patent Document 1

Patent Public Disclosure No. 60-190646 (See FIGS. 1 and 2)

The conventional technique has the following problems.

<Problem> It costs high to produce the engine.

When producing an engine of a different specification by replacing the cylinder block, the following matter is considered.

For example, while an engine which has a water pump arranged at a front end portion of the cylinder block is deemed as an engine of front-end pump arrangement type, an engine which has a water pump arranged at a rear end portion of the cylinder block is regarded as an engine of rear-end pump arrangement type. In this case, it is considered to replace the cylinder block of the engine of the former specification with the cylinder block of the engine of the latter specification and vice versa.

However, as shown in FIG. 16, the cylinder block of the conventional engine is only at the front end portion of the side water passage 103, provided with the opening 103*a* which communicates the side water passage 103 with the water pump 110 but is not provided at the rear end portion thereof with such an opening. Therefore, it cannot be replaced with the cylinder block of the engine of rear-end pump arrangement type.

As such, in the conventional multi-cylinder engine, it is impossible to replace the cylinder block with another one, which entails a high production cost of the engine.

SUMMARY OF THE INVENTION

Then the present invention has an object to provide a multi-cylinder engine and a method for alternatively producing multi-cylinder engines, capable of solving the above problem. More specifically, it aims at providing a multi-cylinder engine able to make its cylinder block common with a cylinder block of another engine of a different specification as well as a method for alternatively producing multi-cylinder engines.

(Inventions of Claims 1 to 6)

Each of the inventions as set forth in claims 1 to 6 has the following primary featuring matter.

Each of the inventions as claimed in claims 1 to 6, as shown in FIG. 1 or FIG. 11, relates to a multi-cylinder engine which provides at a front end portion and a rear end portion of a side water passage 3, openings 3*a* and 3*b* each for communicating the side water passage 3 with a water pump 10. Thus even if the water pump 10 is arranged at either of the front and rear end portions, the opening of the side water passage 3 near the end portion where the water pump 10 is arranged can communicate the side water passage 3 with this water pump 10.

Particularly, claim 4, as exemplified in FIG. 1, claims an engine which arranges the water pump 10 at an end portion where a timing transmission device 8 is disposed. Claim 5 sets forth an engine which is used as an engine to be loaded on a tractor. Claim 6 concerns an engine which arranges the water pump 10 at an end portion opposite to the end portion where the timing transmission device 8 is disposed, as exemplified in FIG. 12.

(Inventions as Set Forth in Claims 7 and 8)

Each of the inventions as set forth in claims 7 and 8 has the following main featuring matter.

Either of the inventions as claimed in claims 7 and 8 is applied to a vertical engine as shown in FIG. 3. The invention of claim 7 opposes an outlet 5 of the side water passage 3 to a lower portion of a cylinder jacket 4. The invention of claim 8 vertically arranges the side water passage 3 and a pair of upper and lower shafts 6, 7 along the cylinder jacket 4 and the cylinder walls 12.

(Inventions as Set Forth in Claims 9 to 11)

Each of the inventions as set forth in claims 9 to 11 has the following essential featuring matter, Each of the inventions as claimed in claims 9 to 11, as exemplified in FIG. 1 or FIG. 11, provides a plurality of outlets 5 in the side water passage 3 passing by all the cylinder walls 12. These outlets 5 are arranged at ends opposed longitudinally of the side water passage 3 and at a mid portion thereof.

(Inventions as Set Forth in Claims 12 to 15)

Each of the inventions as set forth in claims 12 to 15 has the following main featuring matter.

Each of the inventions as claimed in claims 12 to 15, as exemplified in FIG. 1 or FIG. 11, forms an inter-cylinder transverse water passage 17 widthwise of the cylinder block 1, in a connection wall 16 when connecting adjacent cylinder walls 12, 12 to each other.

(Invention of Claim 16)

The invention of claim 16 has the following primary featuring matter.

The invention of claim 16, as exemplified in FIGS. 1, 2, 9 and 10, supplies lubricating oil to a side oil passage 2, while making it bypass the timing transmission device 8, via an oil filter 2*b*, a case-side bypassing oil passage 43*c* and a block-side bypassing oil passage 1*a* in the mentioned order.

(Inventions as Set Forth in Claims 17 to 19)

Each of the inventions as set forth in claims 17 to 19 has the following main featuring matter.

Each of the inventions as claimed in claims 17 to 19 concerns a method for alternatively producing multi-cylinder engines, which takes a cylinder block 1 as a common part, provides a consecutive side water passage 3 oriented in the front and rear direction and passing by each of the cylinder walls 12 as the cylinder block 1 of the common part, and introduces cooling water from the radiator into the cylinder jacket 4 laterally through the side water passage 3, when producing alternatively an engine of front end-pump arrangement type as shown in FIG. 1 and an engine of rear-end pump arrangement type as illustrated in FIG. 11. The method employs the side water passage 3 which has front and rear end portions provided with front and rear openings 3*a*, 3*b* for communicating the side water passage 3 with the water pump 10.

EFFECT OF THE INVENTION (Inventions of Claims 1 to 6)

<Effect> It is possible to reduce production cost of the engine.

In the event that an engine which has the cylinder block 1 provided at its front end portion with the water pump 10 as shown in FIG. 1 is taken as an engine of front-end pump arrangement type, whereas an engine which has the cylinder block 1 provided at its rear end with the water pump 10 as shown in FIG. 11 is deemed as an engine of rear-end pump arrangement type, there are following advantages.

Even if the water pump 10 is arranged at either of the front and rear end portions of the cylinder block 1, the side water passage 3 can be communicated with the water pump 10. This makes it possible for the engine of front-end pump arrangement type and the engine of rear-end pump arrangement type to have the cylinder block 1 as a common part, which reduces the production cost of the engine.

Further, the cylinder block 1 of the present invention introduces the cooling water into the cylinder jacket 4 laterally through the side water passage 3. Therefore, even if it is used in an engine of a different specification, the cooling water which passes through the side water passage 3 flows only reversedly in the front and rear direction but the cooling water which is introduced into the cylinder jacket 4 laterally through the side water passage 3 does not change largely its direction of flow to result in only a small fluctuation of cooling condition of each cylinder wall 12 and therefore being able to secure appropriate cooling condition.

Particularly, as shown in FIG. 1, the invention of claim 4 gathers the timing transmission device 8 and the water pump 10 to one of the end portions, which results in facilitating maintenance. The invention of claim 5 arranges the timing transmission device 8 at the end portion away from an operation seat of a tractor. This can not only arrange a hydraulic piping, an interlockingly connecting rod and the like, which are ordinarily disposed at a position near an operator's feet, without interfering the timing transmission device 8 or the like but also make the operator watch the front wheel from the operator's seat to result in improving loading conditions and operation conditions. As shown in FIG. 11, the invention of claim 6 separates the timing transmission device 8 from the water pump 10 in the front and rear direction. This makes it easy to take a weight balance in the front and rear direction of the engine.

(Invention of Claim 7)

<Effect> It is possible to warm or cool the upper and lower portions of every cylinder wall uniformly.

As shown in FIG. 3, the side water passage 3 has the outlet 5 opposed to the lower portion of the cylinder jacket 4. Thus the cooling water which has flowed out of the outlet 5 of the side water passage 3 floats up to an upper portion of the cylinder jacket 4 after it has passed through the lower portion of the cylinder jacket 4, to result in uniformly warming and cooling the upper and lower portions of every cylinder wall 12. Therefore, during a warm operation, every cylinder wall 12 has its lower side portion warmed as well as its upper side portion, which makes it hard to cause seizure of a piston 24. In addition, during a normal operation, since every cylinder wall 12 has its upper side portion fully cooled as well as its lower side portion, there is seldom formed a gap between the lower side portion and a piston ring to result in hardly causing a leakage of the blow-by gas and a rise-up of oil into a combustion chamber.

(Invention of Claim 8)

<Effect> It is possible to reduce a horizontal width of the engine.

As shown in FIG. 3, the side water passage 3 and the pair of upper and lower shafts 6, 7 are arranged along the cylinder jacket 4 and the cylinder walls 12 vertically. Accordingly, when compared with a case where these are arranged in parallel with each other widthwise, it is possible to reduce the width dimension of the engine.

(Invention of Claim 9)

<Effect> It is possible to uniformly warm and cool all the cylinder walls.

As shown in FIG. 1 or FIG. 11, there are provided a plurality of outlets 5 in the side water passage 3 which passes by all the cylinder walls 12 and the plurality of outlets 5 are arranged at the ends opposed longitudinally of the side water passage 3 and at a mid portion thereof. This allows the cooling water to be evenly distributed toward all the cylinder walls 12, thereby uniformly warming and cooling all the cylinder walls 12.

(Invention of Claim 10)

<Effect> It is possible to reduce the horizontal width of the engine.

As illustrated in FIG. 1 or FIG. 11, a tappet guide hole 14 of a valve operating device is provided within a wall formed between adjacent outlets 5, 5 of the side water passage 3. Consequently, when compared with a case where the outlets 5 are arranged in parallel with the tappet guide hole 14 widthwise, it is possible to reduce the horizontal width of the engine.

(Invention of Claim 11)

<Effect> It is possible to uniformly warm and cool front and rear portions of every cylinder wall.

As illustrated in FIG. 1 or FIG. 11, the side water passage 3 has each of its outlets 5 opposed to a laterally projecting end surface 15 of every cylinder wall 12. Thus when a longitudinal direction of the cylinder block 1 is regarded as a front and rear direction, the cooling water flows laterally from every outlet 5 of the side water passage 3 into the cylinder jacket 4 and then collides against the end surface 15 of every cylinder wall 12 to be evenly divided in the front and rear direction, thereby uniformly warming and cooling the front and rear portions of every cylinder wall 12.

(Invention of Claim 12)

<Effect> A connection wall between adjacent cylinder bores is highly cooled.

As shown in FIG. 1, FIG. 4 or FIG. 11, when connecting adjoining cylinder walls 12, 12, the connection wall 16 is formed with an inter-cylinder transverse water passage 17 running widthwise of the cylinder block 1. Accordingly, when taking a width direction of the cylinder block 1 as a lateral direction, the cooling water which has flowed laterally from the outlets 5 of the side water passage 3 into the cylinder jacket 4 is pushed into the inter-cylinder transverse water passage 17. This allows the cooling water to smoothly pass through the water passage 17, thereby highly cooling the connection wall 16 between the adjacent cylinder bores.

(Invention of Claim 13)

<Effect> It is possible to uniformly warm and cool both sides of the engine.

As illustrated in FIG. 8 or FIG. 15, the cooling water which has passed through the inter-cylinder transverse water passage 17 returns to cross an inter-port transverse water passage 21. This makes it possible to uniformly warm and cool the both sides of the engine.

(Invention of Claim 14)

<Effect> It is possible to uniformly warm and cool the whole engine.

As shown in FIG. 8 or FIG. 15, the cooling water passes across an interior area of the cylinder block 1 and circulates all over within a cylinder head 18 vertically and horizontally to result in the possibility of uniformly warming and cooling the whole engine.

(Invention of Claim 15)

<Effect> Intake air is filled at a high rate.

As shown in FIG. 8 or FIG. 15, the cooling water which passes through the inter-port transverse water passage 21 is made to flow from an intake air distributing means 22 on one side of the cylinder head 18 to an exhaust air converging means 23 on the other side thereof. This makes it hard for the exhaust air heat to be conducted to the intake air distributing means 22 with the result of being able to inhibit the temperature rise of the intake air. Thus the intake air is filled at a high rate.

(Invention of Claim 16)

<Effect> It is possible to form an oil passage which does not interfere with the timing transmission device.

As shown in FIGS. 1, 2, 9 and 10, lubricating oil is fed to the side oil passage 2, while making it bypass the timing transmission device 8, via the oil filter 2*b*, the case-side bypassing oil passage 43*c* and the block-side bypassing passage 1*a* in the mentioned order. Therefore, it is possible to form an oil passage which does not interfere with the timing transmission device 8.

(Inventions of Claims 17 to 19)

<Effect> It is possible to reduce the production cost of the engine.

As shown in FIGS. 1 and 11, the engine of front-end pump arrangement type can have the cylinder block common with that of the engine of rear-end pump arrangement type to result in reducing the production cost of the engine as well as in the case of the inventions of claims 1 to 6.

Especially, the invention of claim 19 offers the same effect as the invention of claim 5.

BRIEF DESCRIPTION OF THE DRAWINGS

FIG. 7(A) is a plan view. FIG. 7(B) is a sectional view taken along a line B—B in FIG. 7(A). FIG. 7(C) is a sectional view taken along a line C—C in FIG. 7(A). FIG. 7(D) is a sectional view taken along a line D—D in FIG. 7(A);

FIG. 9 shows a structure of a front end portion of the engine shown in FIG. 1.

FIG. 10 is an explanatory view of the timing transmission case of FIG. 9(B).

FIG. 14(A) is a front view of a rear end portion of the cylinder block. FIG. 14(B) is a front view of a rear case;

FIG. 16 is an explanatory view of prior art.

MOST PREFERRED EMBODIMENTS OF THE INVENTION

Embodiments of the present invention are explained based on the drawings. FIGS. 1 to 10 explain a first embodiment of the present invention. FIGS. 11 to 15 explain a second embodiment of the present invention. In each of those embodiments, explanation is given for a water-cooled vertical multi-cylinder diesel engine.

Each of the embodiments of the present invention is outlined as follows.

In the first embodiment shown in FIGS. 1 to 10, a timing transmission device 8 is arranged at one end portion in a longitudinal direction of a cylinder block 1. On the assumption that while the longitudinal direction of the cylinder block 1 is deemed as a front and rear direction, the end portion where the timing transmission device 8 is arranged is regarded as a front end portion, the first embodiment is an engine of front-end pump arrangement type where the cylinder block 1 has a front end portion provided with a water pump 10 and an oil filter 2*b*.

The second embodiment shown in FIGS. 11 to 15 is an engine of rear-end pump arrangement type where the cylinder block 1 has a rear end portion provided with the water pump 10 and the oil filter 2*b*.

After having explained the first and the second embodiments, an explanation is given for a method of alternatively producing these embodiments.

The first embodiment as shown in FIGS. 1 to 10 is outlined as follows.

Figure 1:
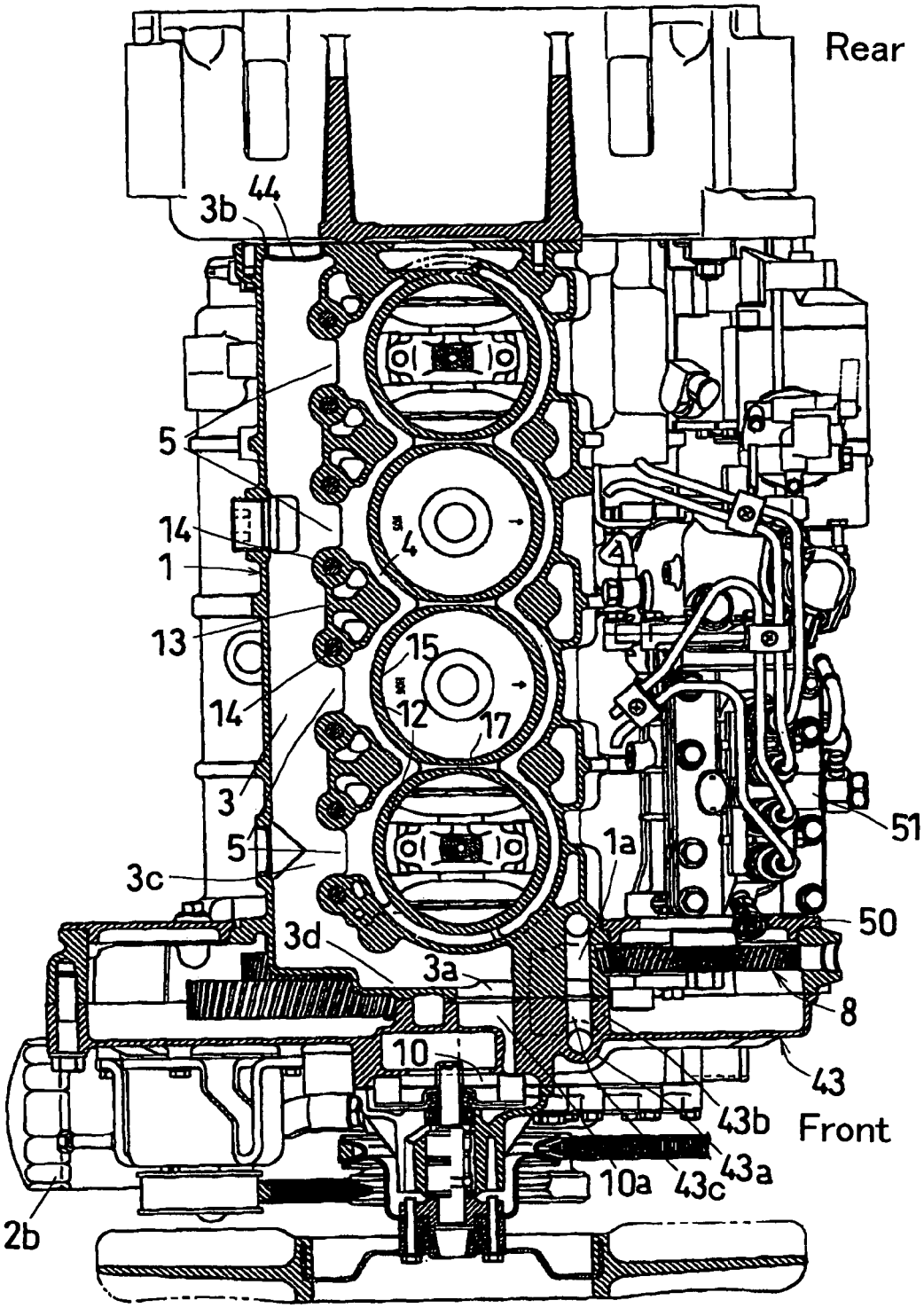
FIG. 1 is a plan view, in cross section, including a sectional view of a side water passage of an engine of front-end pump arrangement type according to a first embodiment of the present invention.
Figure 5:
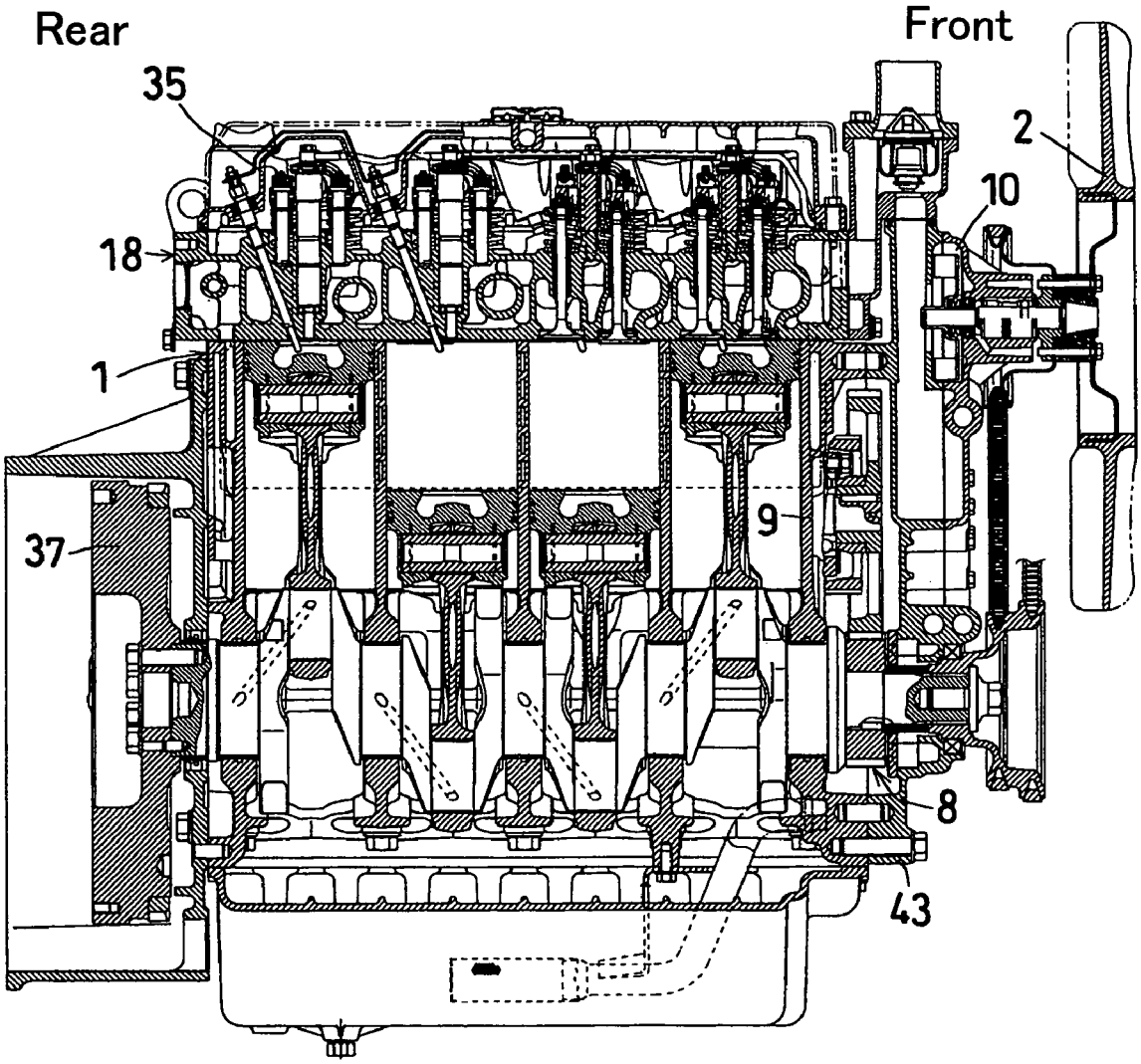
FIG. 5 is a side view, in vertical section, of the engine shown in FIG. 1.

As shown in FIG. 5, a cylinder head 18 is assembled to an upper portion of the cylinder block 1. A head cover 35 is assembled to an upper portion of this assembly. Arranged along a front end wall 9 of the cylinder block 1 is the timing transmission device 8, which is in turn covered by a timing transmission case 43. A water pump 10 with a cooling fan 2 is attached to the timing transmission case 43. A fly wheel 37 is arranged at the rear end portion of the cylinder block 1. The timing transmission device 8 is a timing gear train. As illustrated in FIG. 1, a flange 50 projects laterally from the front end portion of the cylinder block 1. A fuel injection pump 51 is attached to the flange 50 from a rear portion of the latter.

The cylinder block 1 is constructed as follows.

As shown in FIG. 1, the cylinder block 1 is provided with a consecutive side water passage 3 oriented in the front and rear direction and passing by every cylinder wall 12. Cooling water from a radiator is introduced into a cylinder jacket 4 laterally through the side water passage 3. As shown in FIG. 1, the side water passage 3 is formed over the entirety of the cylinder block 1 and has front and rear end portions provided with front and rear openings 3*a*, 3*b* which communicate the side water passage 3 with the water pump 10. Thus even if the water pump 10 is arranged at either of the front and rear end portions of the cylinder block 1, the opening of the side water passage 3 near the end portion where the water pump 10 is arranged can communicate the side water passage 3 with the water pump 10. The water pump 10 can be arranged at either of the front and rear end portions of the cylinder block 1.

In this embodiment, as shown in FIG. 1, the water pump 10 is arranged at the front one of the front and rear end portions of the cylinder block 1. The front end opening 3*a* of the side water passage 3 near the front end portion where the water pump 10 is arranged can communicate the side water passage 3 with the water pump 10. The opening 3*b* at the rear end portion of the side water passage 3 is sealed by a plug 44.

Figure 2:
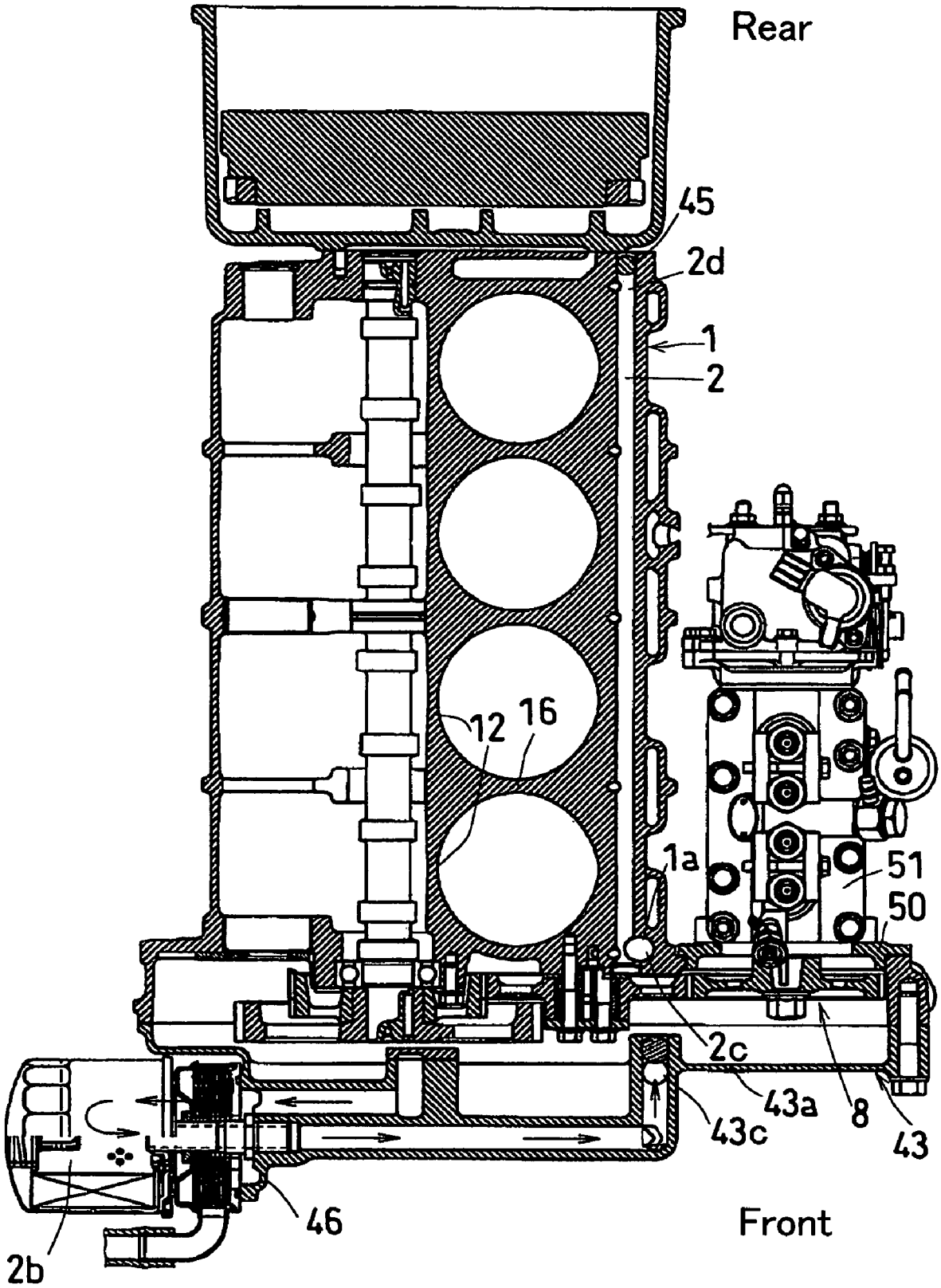
FIG. 2 is a plan view, in cross section, including a sectional view of a side oil passage of the engine shown in FIG. 1.
Figure 4:
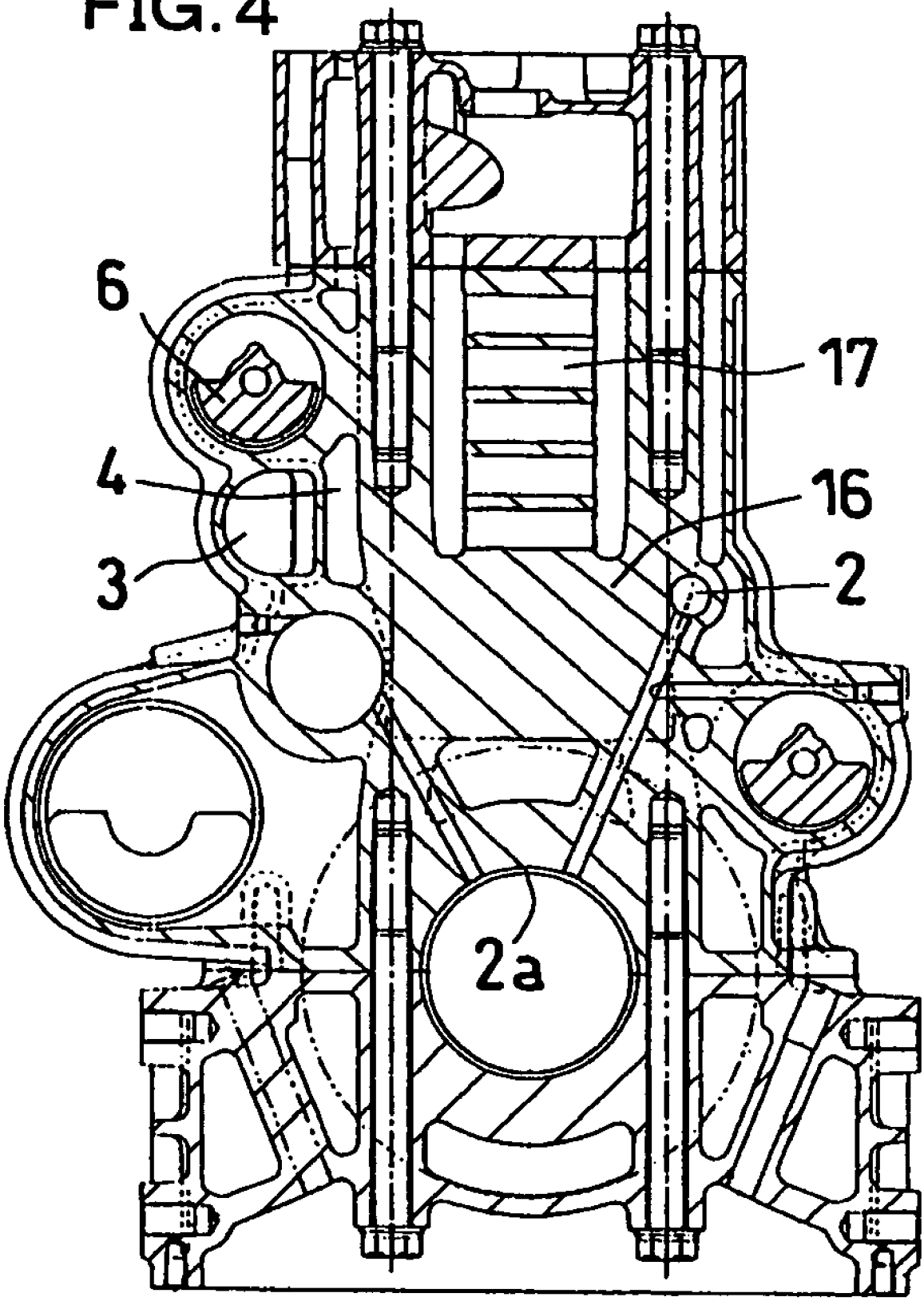
FIG. 4 is a front view, in vertical section, of a cylinder block of the engine shown in FIG. 1.

As shown in FIG. 2, the cylinder block 1 is provided with a consecutive side oil passage 2 oriented in the front and rear direction. And as shown in FIG. 4, lubricating oil is introduced into a bearing portion 2*a* of a crank shaft through the side oil passage 2. As shown in FIG. 2, the side oil passage 2 has front and rear end portions provided with front and rear openings 2*c*, 2*d* which communicate the side oil passage 2 with the oil filter 2*b* through a seat 46 for attaching the filter 2*b*. Even if the filter attaching seat 46 is arranged at either of the front and rear end portions of the cylinder block 1, the opening of the side oil passage 2 near the end portion where the filter attaching seat 46 is arranged can communicate the side oil passage 2 with the oil filter 2*b* through the filter attaching seat 46.

In this embodiment, the filter attaching seat 46 is arranged at the front one of the front and rear end portions of the cylinder block 1 where the water pump 10 is disposed. The front end opening 2*c* of the side oil passage 2 near the front end portion where the filter attaching seat 46 is arranged communicates the side oil passage 2 with the oil filter 2*b* through the filter attaching seat 46 at the front end portion and the rear end opening 2*d* of the side oil passage 2 is sealed by another plug 45.

In this embodiment, as shown in FIG. 1, this engine in which the timing transmission device 8 is disposed at the front one of the front and rear end portions of the cylinder block 1 where the water pump 10 is arranged is used as the engine to be loaded on a tractor with the water pump 10 disposed at an end portion of the cylinder block 1 away from the operator's seat.

The side water passage 3 is constructed as follows.

Figure 3:
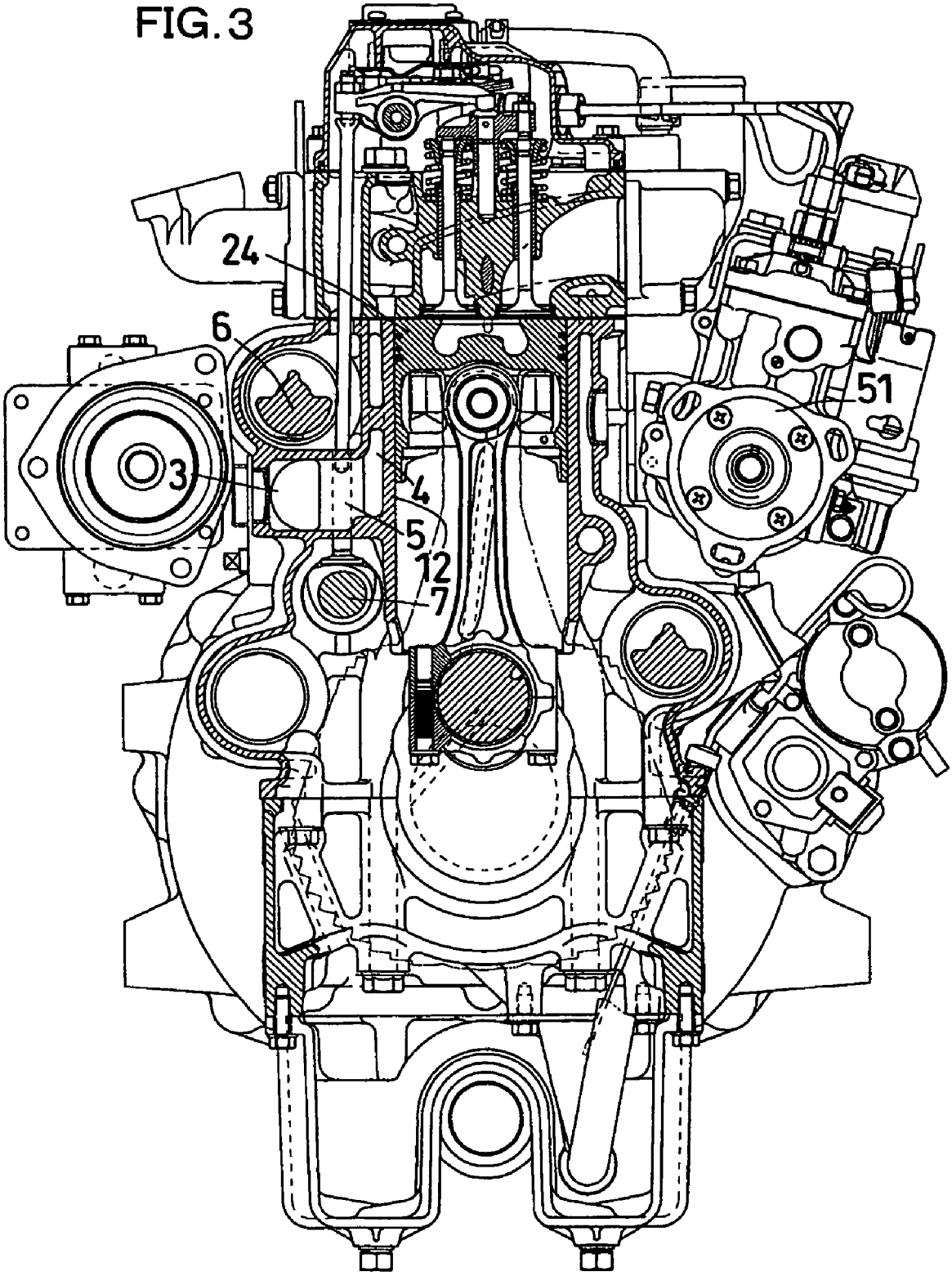
FIG. 3 is a front view, in vertical section, of the engine shown in FIG. 1.

As shown in FIG. 3, when arranging the side water passage 3 together with a pair of upper and lower shafts 6, 7 on a left side of the cylinder block 1, the side water passage 3 and the pair of upper and lower shafts 6, 7 are disposed along and vertically in parallel with the cylinder jacket 4 and the cylinder walls 12. This can reduce the width dimension of the engine when compared with the case of arranging them widthwise in parallel with each other. While the upper shaft 6 of the side water passage 3 is a secondary balancer shaft, the lower shaft 7 of the side water passage 3 is a valve operating cam shaft.

Further, as shown in FIG. 1, the side water passage 3 is formed over the entirety of the cylinder block 1 and passes by all the cylinder walls 12. The side water passage 3 is provided with a plurality of outlets 5, which are arranged at opposite ends and at a mid portion of the side water passage 3. Each of the outlets 5 faces an end surface 15 projecting laterally of every cylinder wall 12. This allows cooling water to be distributed toward all the cylinder walls 12 with the result of uniformly warming and cooling all the cylinder walls 12. And the cooling water which has flowed into the cylinder jacket 4 laterally from every outlet 5 of the side water passage 3 collides against the end surface 15 projecting laterally of every cylinder wall 12 and is uniformly divided in the front and rear direction, thereby evenly warming and cooling the front and rear portions of every cylinder wall 12. Additionally, a tappet guide hole 14 of the valve operating device is provided within a wall between the adjacent outlets 5, 5 of the side water passage 3. This can reduce the horizontal width more than in the case of arranging the outlets 5 and the tappet guide hole 4 widthwise in parallel with each other.

Besides, as shown in FIG. 3, every outlet 5 of the side water passage 3 is opposed to a lower portion of the cylinder jacket 4. Thus the cooling water which has flowed out of every outlet 5 of the side water passage 3 floats up to an upper portion of the cylinder jacket 4 after having passed the lower portion of the cylinder jacket 4, thereby uniformly warming and cooling the upper and lower portions of every cylinder wall 12. Therefore, during a warm operation, the lower side portion of every cylinder wall 12 is warmed as well as the upper side portion thereof so that the seizure of a piston 24 hardly occurs. Further, during a normal operation, the lower side portion of every cylinder wall 12 is cooled as well as the upper side portion thereof, so that any gap is seldom formed between the lower side portion and a piston ring, which results in hardly causing the leakage of blow-by gas and the rise-up of oil into a combustion chamber.

The cylinder jacket 4 is constructed as follows.

As shown in FIG. 1, in the cylinder block 1, the adjacent cylinder walls 12, 12 are connected to each other and the thus resulted connection wall 16 is formed with an inter-cylinder transverse water passage 17 which runs widthwise of the cylinder block 1. Consequently, as shown in FIG. 1, when taking the width direction of the cylinder block 1 as a lateral direction, the cooling water which has flowed into the cylinder jacket 4 laterally from the outlets 5 of the side water passage 3 is pushed into the inter-cylinder transverse water passage 17. Thus the cooling water smoothly passes through the transverse water passage 17 to highly cool the connection wall 16 between the adjacent cylinder bores.

The head jacket 25 is constructed as follows.

Figure 6:
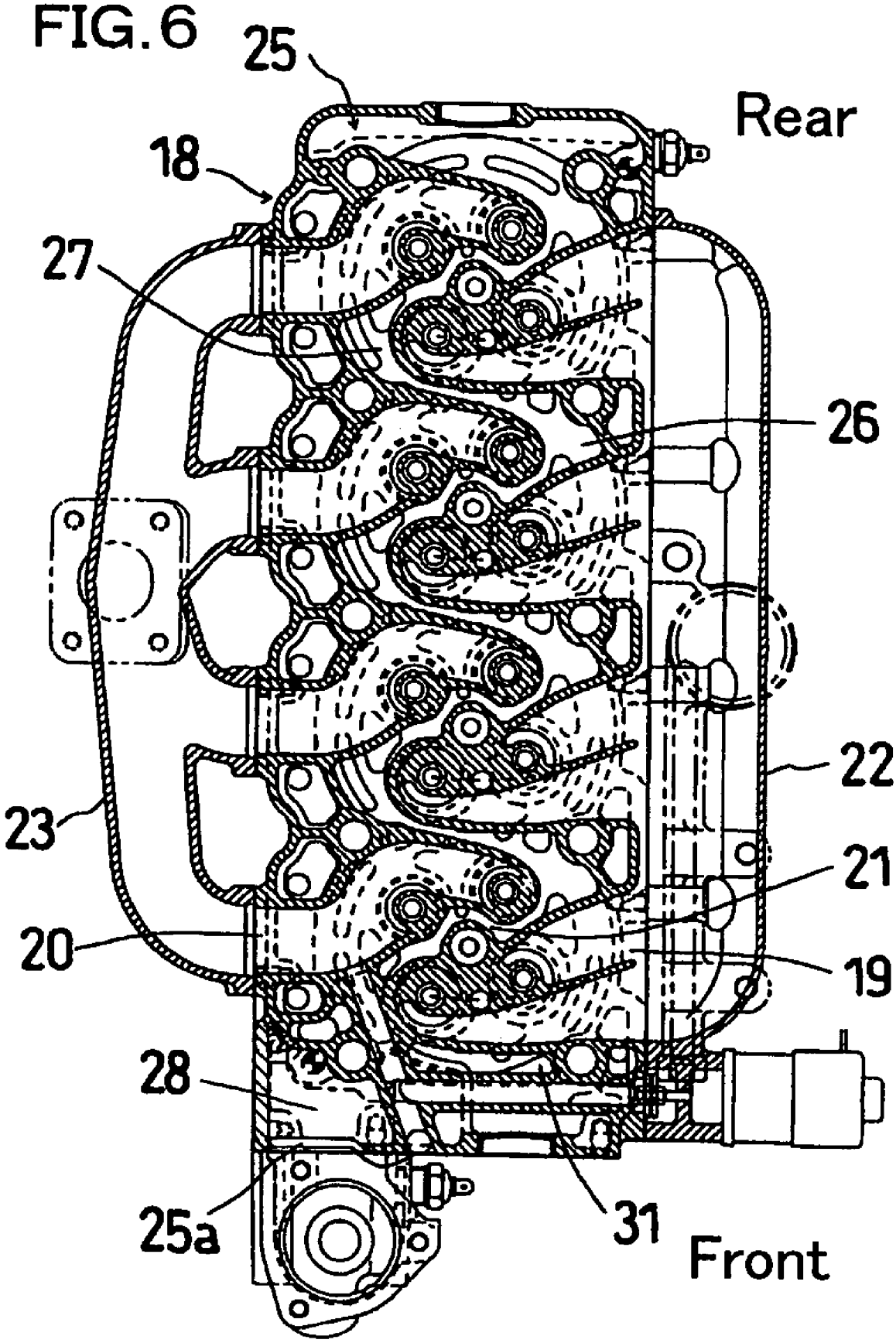
FIG. 6 is a plan view, in cross section, of a cylinder head of the engine shown in FIG. 1.
Figure 7:
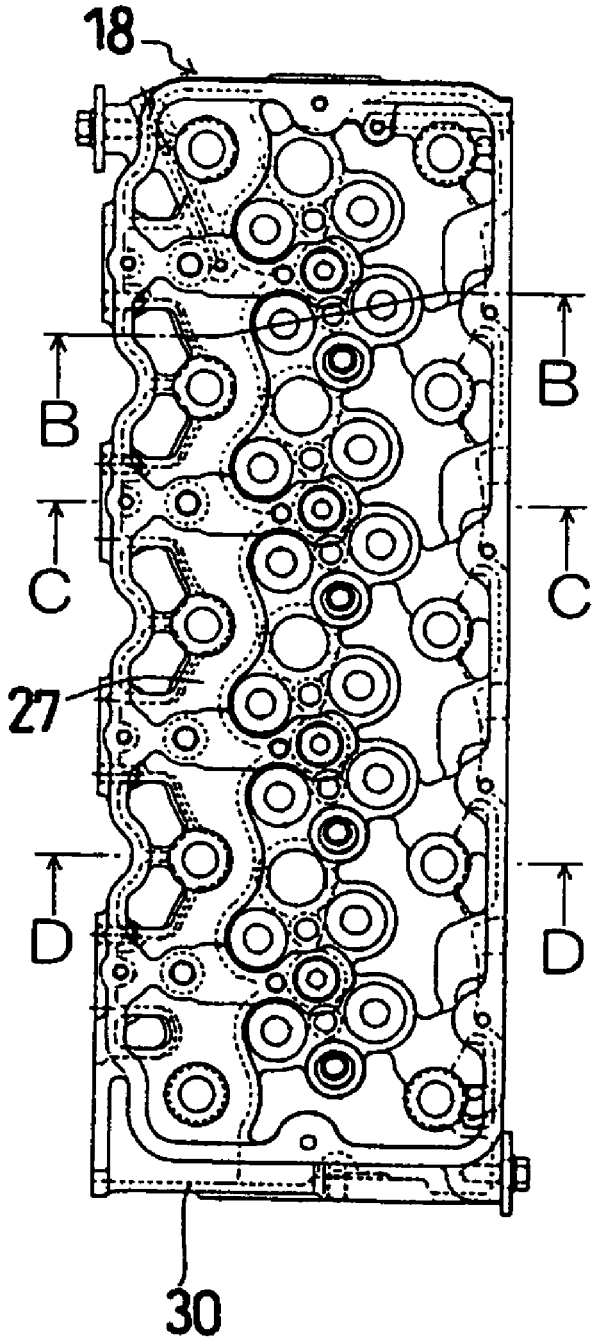
FIG. 7 explains the cylinder head of the engine shown in FIG. 1.
Figure 7:
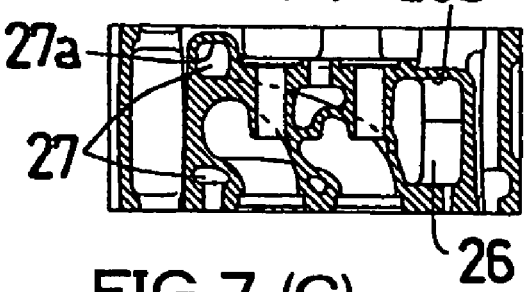
Figure 7:
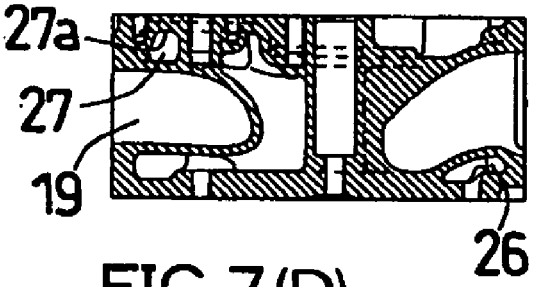
Figure 7:
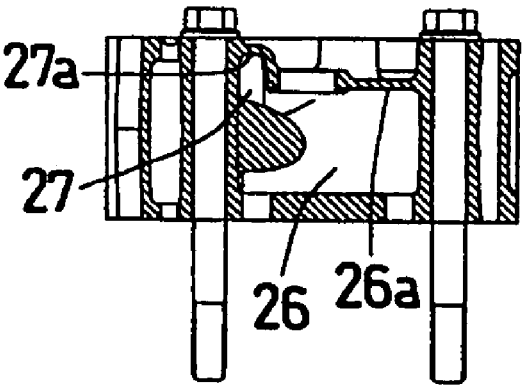

As shown in FIG. 6, a head jacket 25 is provided within a cylinder head 18. The cylinder head 18 has an intake port 19 and an exhaust port 20 between which there is formed an inter-port transverse water passage 21 running widthwise of the cylinder head 18. Further, a head intake side water passage 26 is formed on the side of an intake air distributing means 22 of the cylinder head 18 and a head exhaust side water passage 27 is formed on the side of an exhaust air converging means 23, respectively along a longitudinal direction of the cylinder head 18. The head intake side water passage 26 communicates with the head exhaust side water passage 27 through the inter-port transverse water passage 21.

The cooling water flows as follows.

Figure 8:
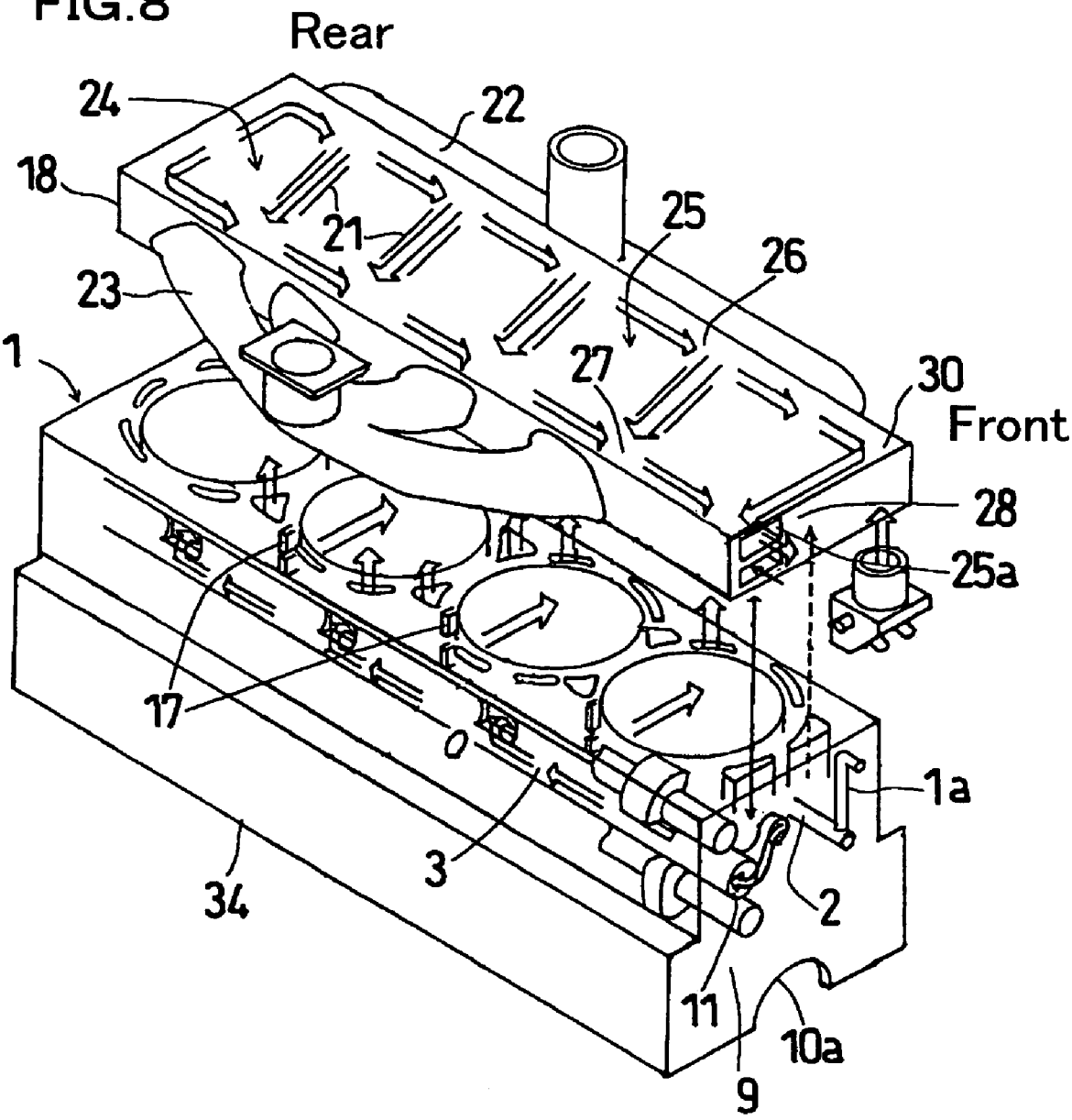
FIG. 8 is a schematic perspective view showing how cooling water of the engine shown in FIG. 1 flows.

As illustrated in FIG. 8, while part of the cooling water which has flowed from the side water passage 3 into the left side of the cylinder jacket 4 floats up to the head exhaust side water passage 27, the remaining part flows into the inter-cylinder transverse water passage 17. A left and front corner portion 28 of the cylinder head 18 has a front surface opened to provide an outlet 25*a* of the head jacket 25. Therefore, the cooling water which has crossed the inter-cylinder water passage 17 from the side water passage 3 to the opposite side floats up to the head intake side water passage 26. The floating-up cooling water is divided into a plurality of inter-port transverse water passages 21 while passing through the head intake side water passage 26 forwardly. The divided cooling water passes through the head exhaust side water passage 27 on the side of the side water passage 3 forwardly while converging thereinto. The cooling water which has passed through the both water passages 26, 27 forwardly converge to be flowed out of the outlet 25*a*. As such, the cooling water goes across an interior area of the cylinder block 1 and circulate all over within the cylinder head 18 vertically and horizontally, so that the engine is warmed and cooled uniformly in its entirety. In addition, since the cooling water which passes through the inter-port transverse water passage 21 flows from the intake air distributing means 22 on one side of the cylinder head 18 to the exhaust air converging means 23 on the other side of the cylinder head 18, the exhaust air heat is hardly transmitted to the intake air distributing means 22 to result in the possibility of preventing the temperature of the intake air from rising. Thus the intake air is filled at a high rate. It is worthy of noting that when the side water passage 3 is arranged on a right side of the cylinder block 1 and a right side surface of the cylinder head 18 is opened to provide the outlet 25*a* of the head jacket 25, the cooling water flows in a direction symmetric with respect to the above-mentioned direction.

The head exhaust side water passage 27 is constructed as follows.

As shown in FIGS. 7(B) to 7(D), the head exhaust side water passage 27 has a ceiling wall under surface 27*a* higher than a ceiling wall under surface 26*a* of the head intake side water passage 26. Thus even if the engine is inclined in the front and rear direction to raise the head exhaust side water passage 27 with the result of producing air pool below the under surface 27*a*, a ceiling wall of the exhaust port 19 is hardly disclosed from the cooling water, thereby allowing the exhaust port 19 to be securedly cooled. For this reason, so-called left and right inclination performance of the engine can be said to be high. Besides, the ceiling wall under surface 27*a* of the head exhaust side water passage 27 which runs along the longitudinal direction of the cylinder head 18 is made high. Accordingly, even if the engine is inclined in the front and rear direction, and the front end portion or the rear end portion of the exhaust side water passage 27 is raised with the result of producing air pool at the front end portion or the rear end portion of the ceiling wall under surface 27*a*, the ceiling wall of the exhaust port 19 at the front end portion or the rear end portion is hardly disclosed from the cooling water, thereby allowing the exhaust port 19 to be cooled securedly. For this reason, the so-called front and rear inclination performance of the engine can be said to be high.

The front end portion of the engine is constructed as follows.

Figure 9A:
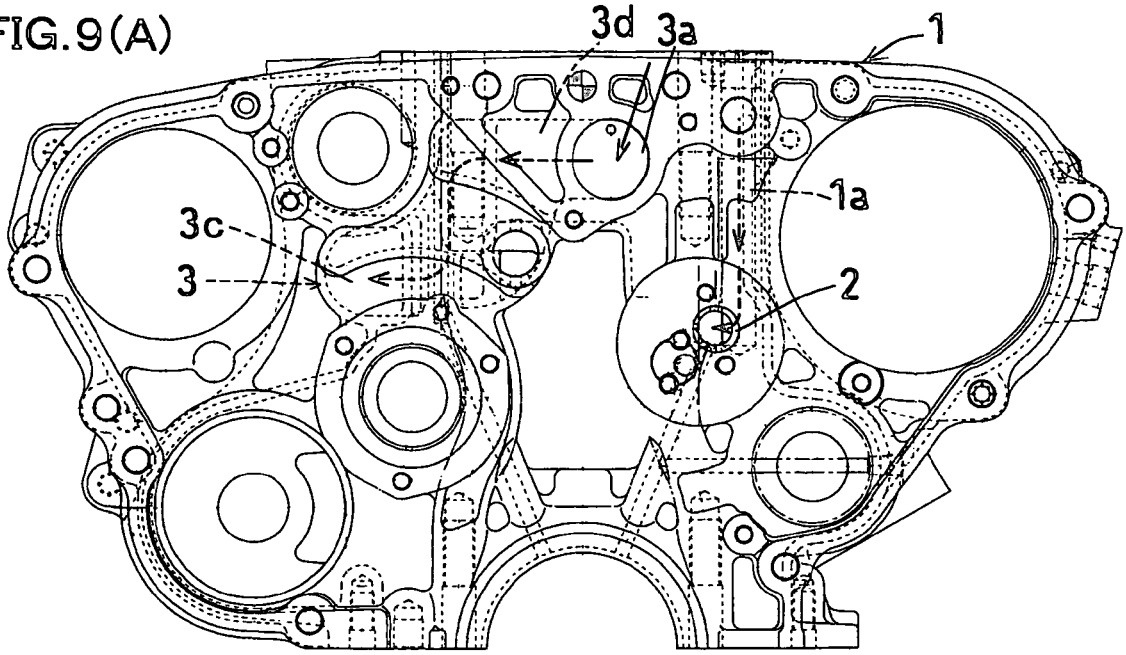
FIG. 9(A) is a front view showing a front end portion of the cylinder block.
Figure 9B:
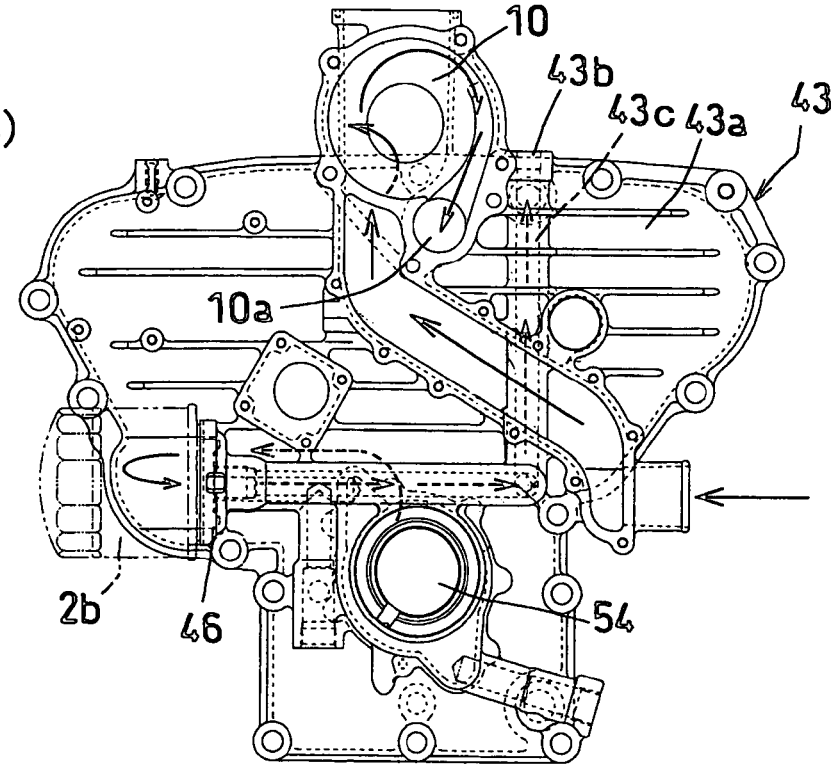
FIG. 9(B) is a front view of a timing transmission case.

As shown in FIG. 1, a timing transmission case 43 is attached to the front end portion of the cylinder block 1. As shown in FIG. 9(B), this timing transmission case 43 has a front wall 43*a* formed with the water pump 10, an oil pump 54 and the filter attaching seat 46. As shown in FIG. 9(A), the cylinder block 1 has a front end wall opened to provide the front end opening 3*a* of the side water passage 3. As illustrated in FIGS. 1 and 9(A), a linear passage 3*c* of the side water passage 3 which runs along a side wall of the cylinder block 1 has a front end portion from which a bypass passage 3*d* of the side water passage 3 is conducted along the front end wall of the cylinder block 1. The bypass passage 3*d* is conducted to an end portion which has a front surface provided with the front end opening 3*a*. The opening 3*a* communicates with a discharge port 10*a* of the water pump 10. As illustrated in FIG. 9(B), the cooling water from a radiator passes through the water pump 10 as indicated by arrows in solid line in FIG. 9(B) and is introduced into the side water passage 3 through the opening 3*a* as designated by an arrow in FIG. 9(A).

Figure 10A:
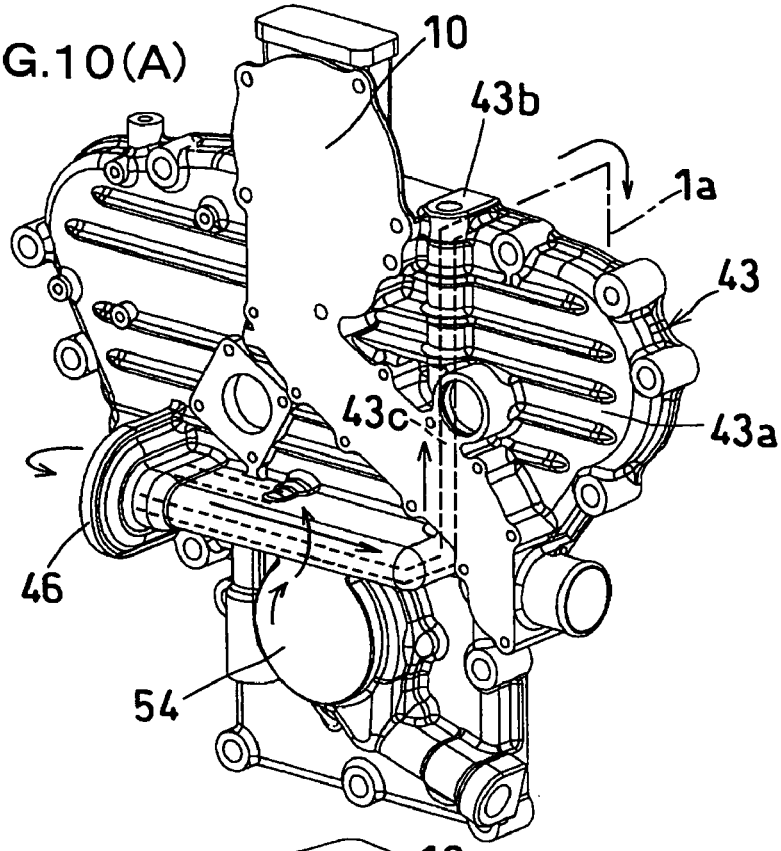
FIG. 10(A) is a perspective view when seen from a front and right upper side.
Figure 10B:
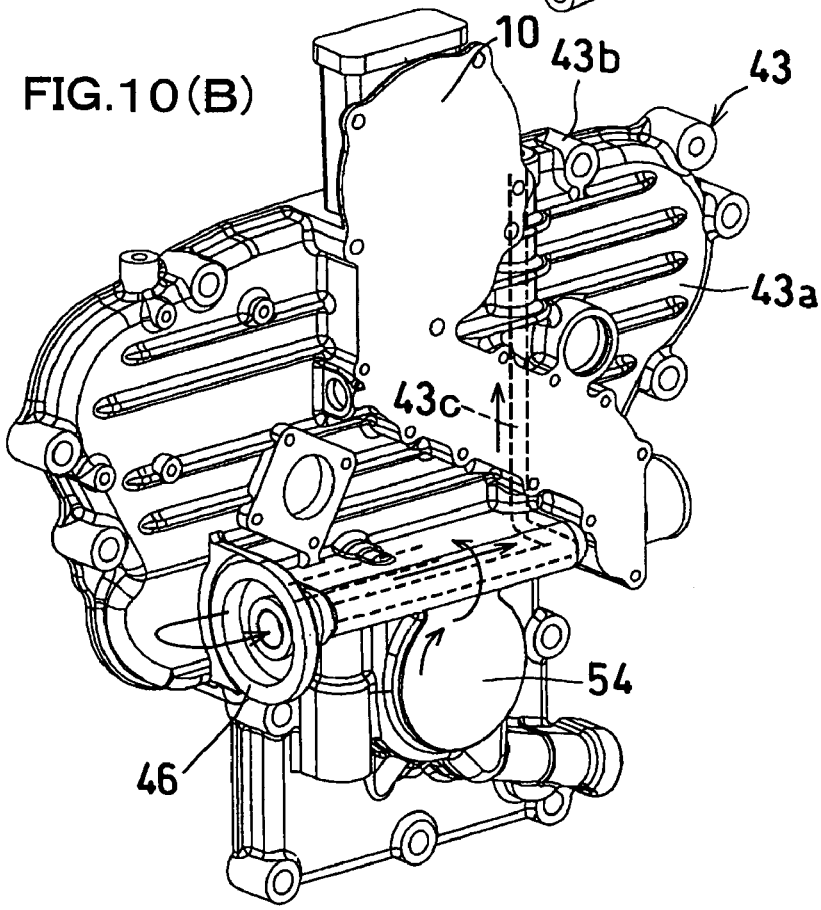
FIG. 10(B) is a perspective view when seen from a front and left upper side.

As shown in FIG. 9(B) as well as in FIG. 10(A) and FIG. (10(B), a case side bypassing oil passage 43*c* is formed along the front wall 43*a* and a peripheral wall 43*b* of the timing transmission case 43. And as shown in FIG. 9(A), the cylinder block 1 has the front wall formed with a block side bypassing oil passage 1*a*. The case side bypassing oil passage 43*c* communicates with the block side bypassing oil passage 1*a*. As indicated by arrows in broken line in FIGS. 9(A) and 9(B) as well as by arrows in solid line in FIGS. 10(A) and 10(B), lubricating oil is fed to the side oil passage 2 through the oil pump 54, the oil filter 2*b*, the case side bypassing oil passage 43*c* and the block side bypassing oil passage 1*a* in the mentioned order, while bypassing the timing transmission device 8.

A second embodiment as shown in FIGS. 11 to 15 is outlined as follows.

Figure 11:
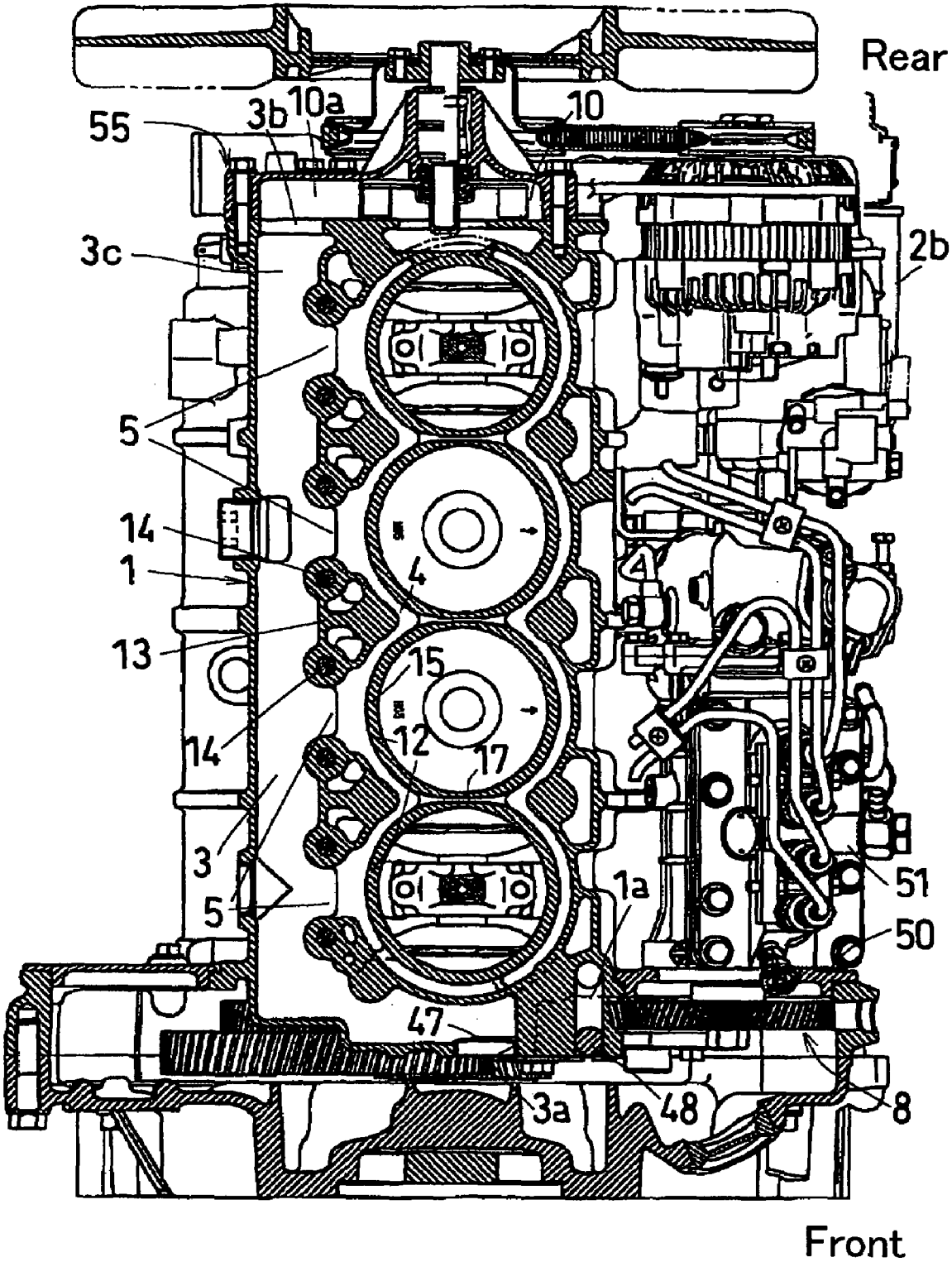
FIG. 11 is a plan view, in cross section, including a sectional view of the side water passage of an engine of rear-end pump arrangement type according to a second embodiment of the present invention.

The second embodiment uses the same cylinder block 1 as that of the first embodiment. As shown in FIG. 11, the water pump 10 is arranged at the rear one of the first and rear end portions of the cylinder block 1. The rear end opening 3*b* of the side water passage 3 near the rear end portion where the water pump 10 is arranged communicates the side water passage 3 with the water pump 10. The front end opening 3*a* of the side water passage 3 is sealed by a plug 47.

Figure 12:
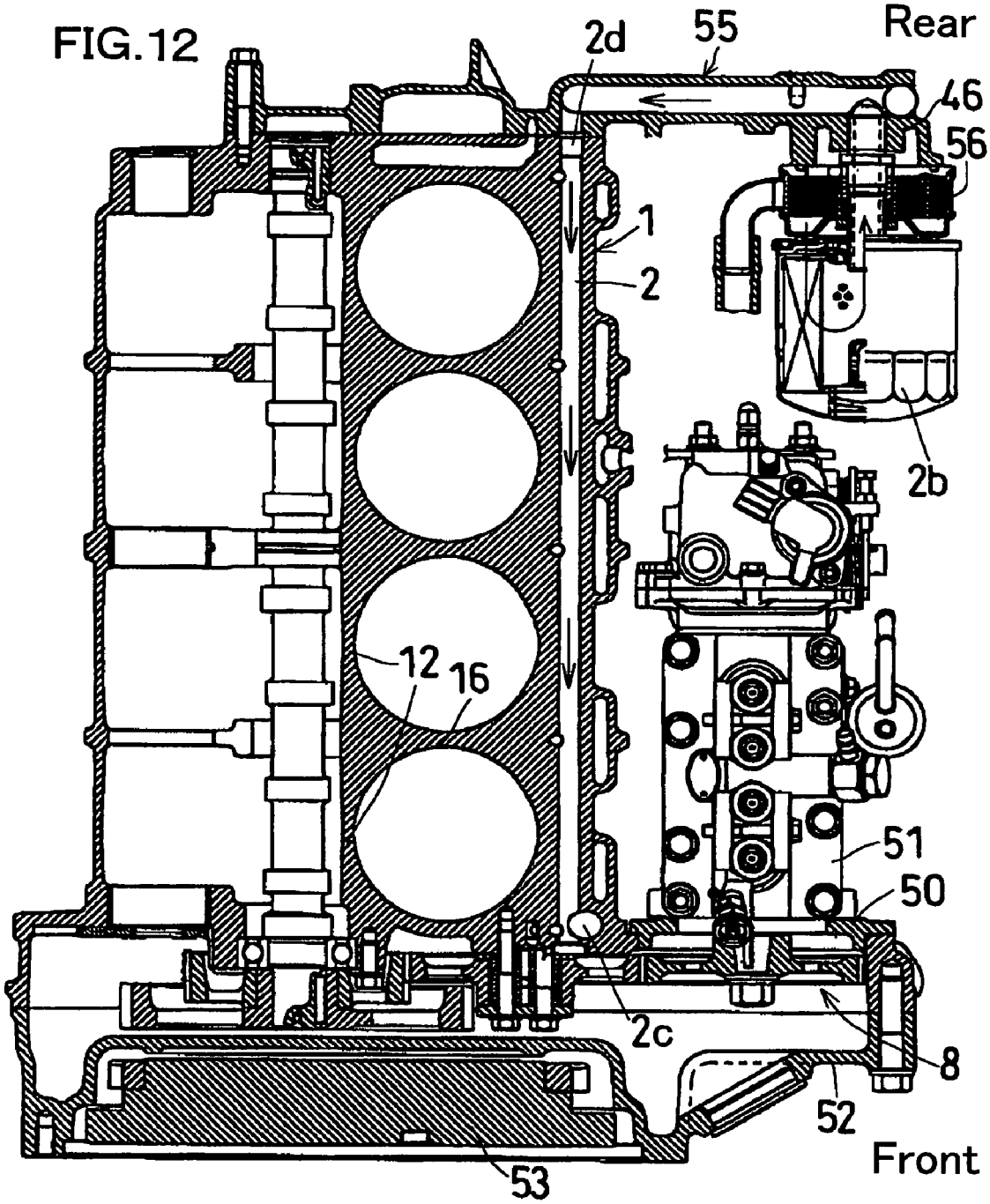
FIG. 12 is a plan view, in cross section, of the side oil passage of the engine shown in FIG. 11.

As shown in FIG. 12, the filter attaching seat 46 is disposed at the rear one of the front and rear end portions of the cylinder block 1 where the water pump 10 is arranged. The rear end opening 2*d* of the side oil passage 2 near the rear end portion where the filter attaching seat 46 is disposed communicates the side oil passage 2 with the oil filter 2*b* through the filter attaching seat 46. The front end opening 2*c* of the side oil passage 2 is sealed by a plug 48 internally fitted into the block side bypassing passage 1*a*.

Figure 13:
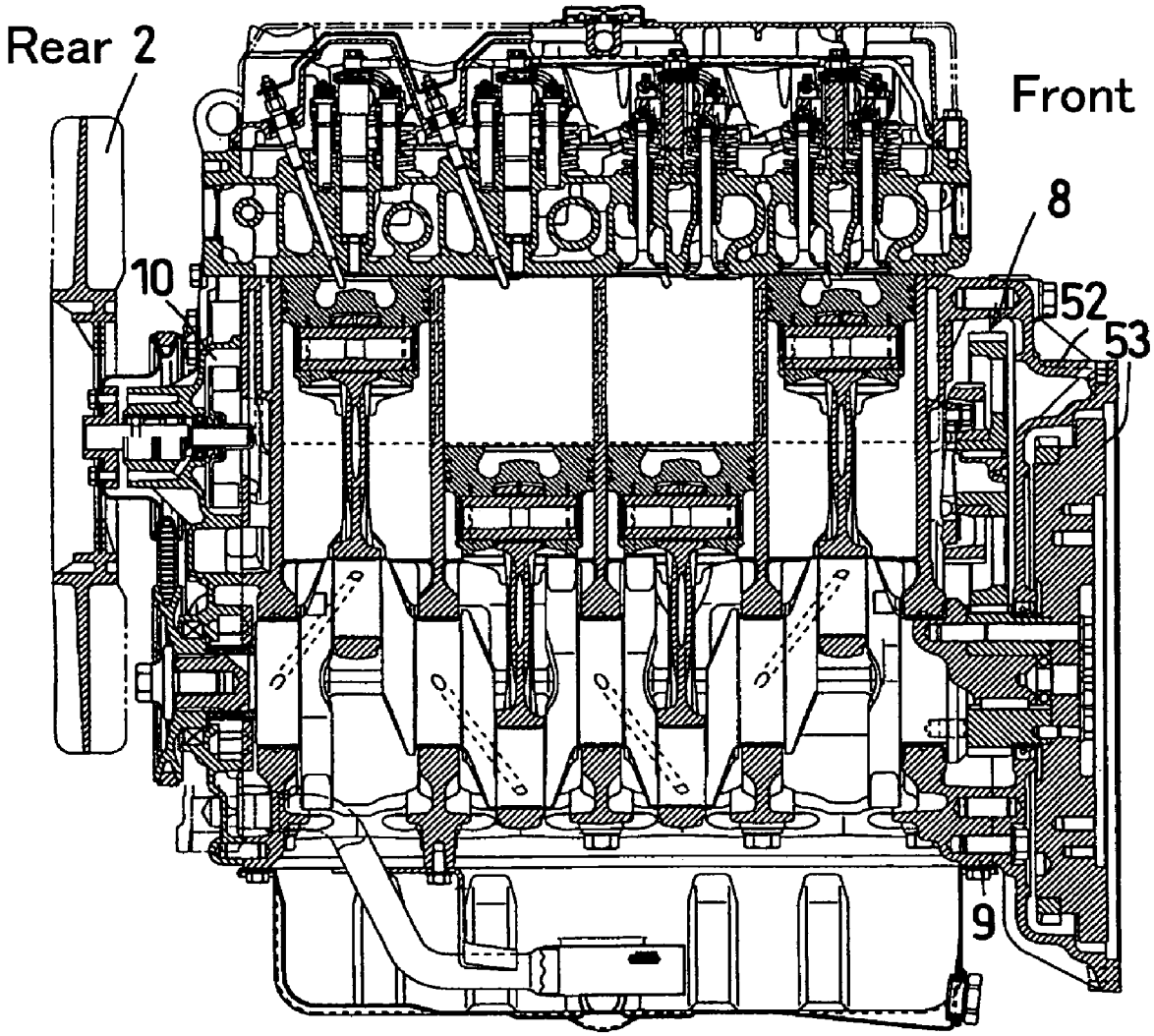
FIG. 13 is a side view, in. vertical section, of the engine shown in FIG. 11.
Figure 14:
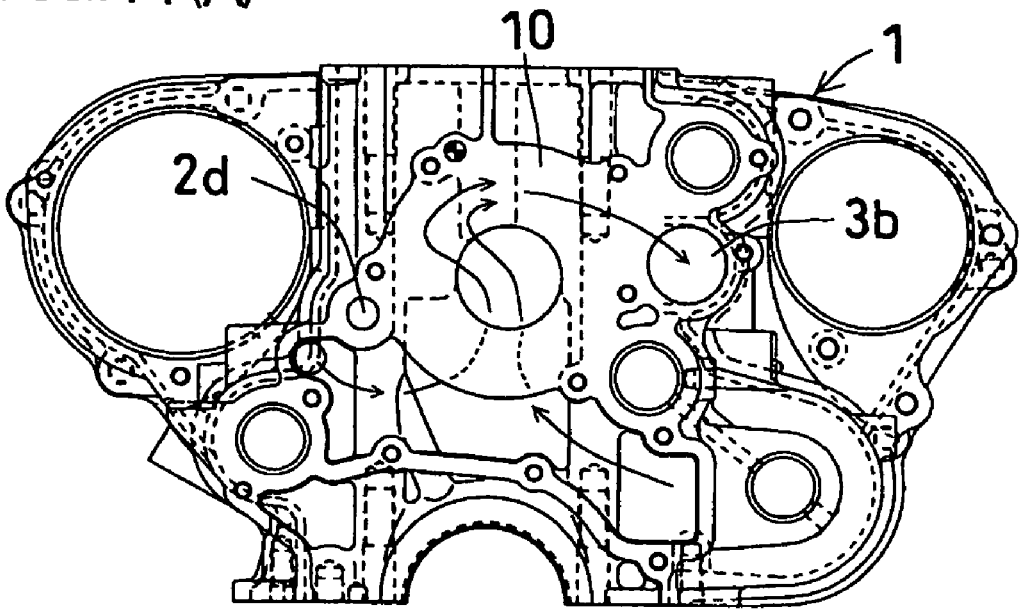
FIG. 14 shows a structure of a rear portion of the engine shown in FIG. 11
Figure 14:
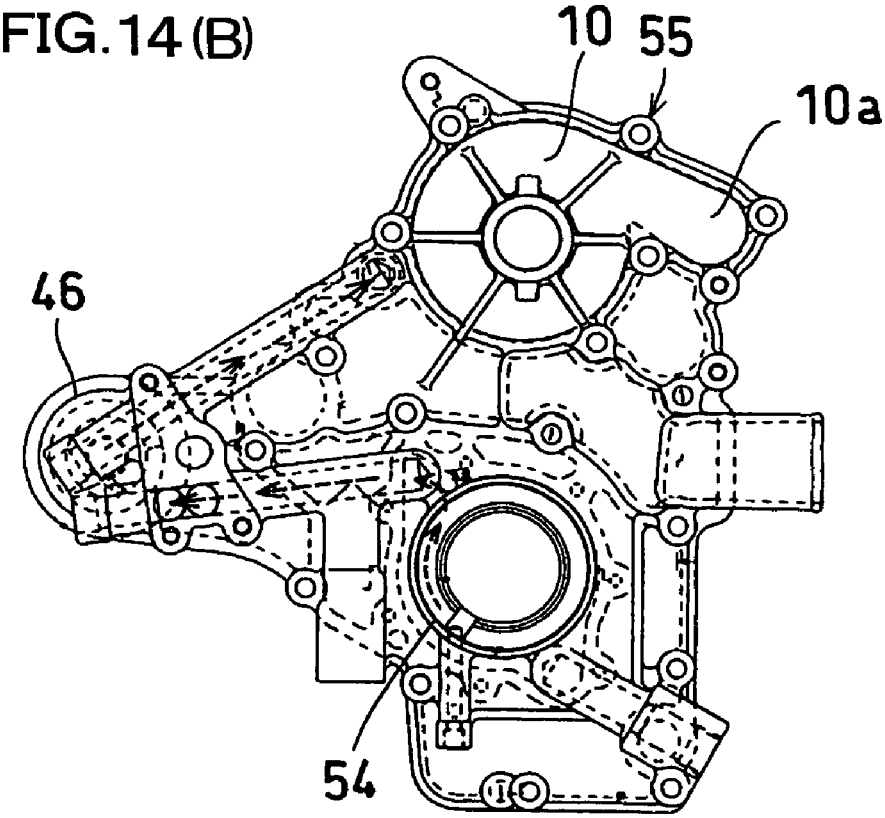

As illustrated in FIG. 13, the timing transmission device 8 is arranged along the front end portion 9 of the cylinder block 1. Further, a fly wheel 53 is disposed along the timing transmission case 52 which covers the timing transmission device 8.

The rear end portion of the engine is constructed as follows.

As shown in FIGS. 11 and 12, a rear case 55 is attached to the rear end portion of the cylinder block 1 and as shown in FIG. 14(B), the rear case 55 is formed with the water pump 10, the oil pump 54 and the filter attaching seat 46. As shown in FIG. 14(A), the cylinder block 1 has a rear end wall opened to provide the rear end opening 3*b* of the side water passage 3. Further, as shown in FIGS. 11 and 14(A), the linear passage 3*c* of the side water passage 3 which rungs along the side wall of the cylinder block 1 has a rear end portion provided with the rear end opening portion 3*b*. The opening 3*b* communicates with a discharge port 10*a* of the water pump 10. As shown in FIG. 9(B), the cooling water from the radiator passes through the water pump 10 as shown by arrows in FIG. 14(A) and is introduced from the rear end opening 3*b* to the side water passage 3.

Figure 15:
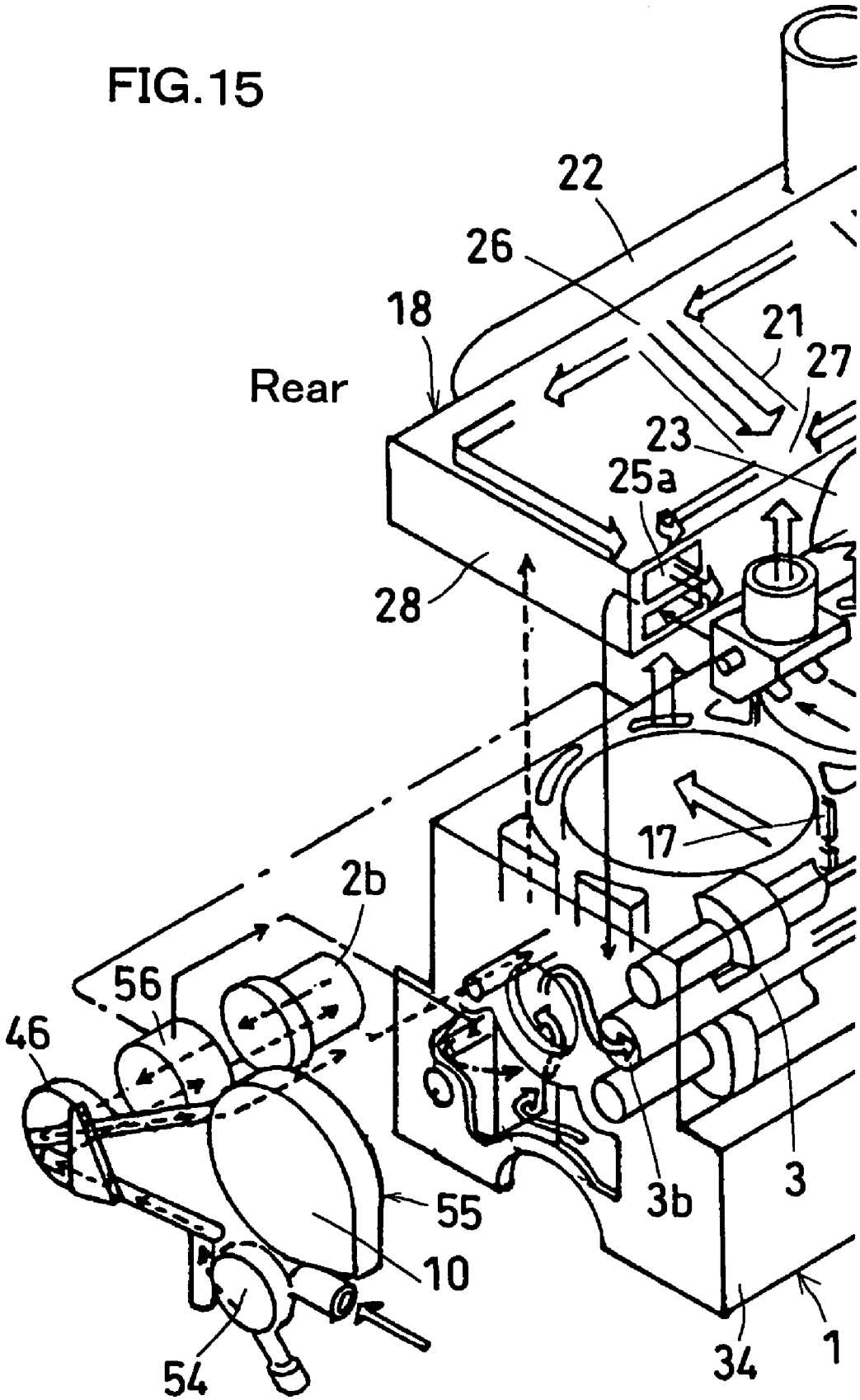
FIG. 15 is a schematic perspective view showing how the cooling water of the engine shown in FIG. 11 flows.
Figure 16A:
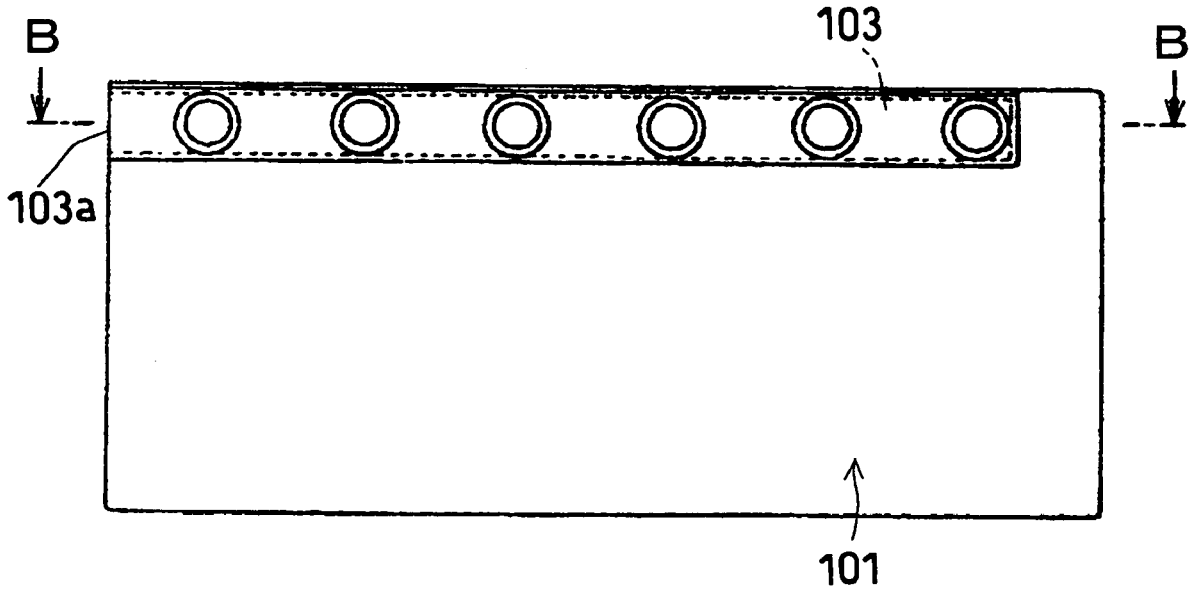
Prior Art FIG.16(A)
FIG. 16(A) is a side view of a cylinder block.
Figure 16B:
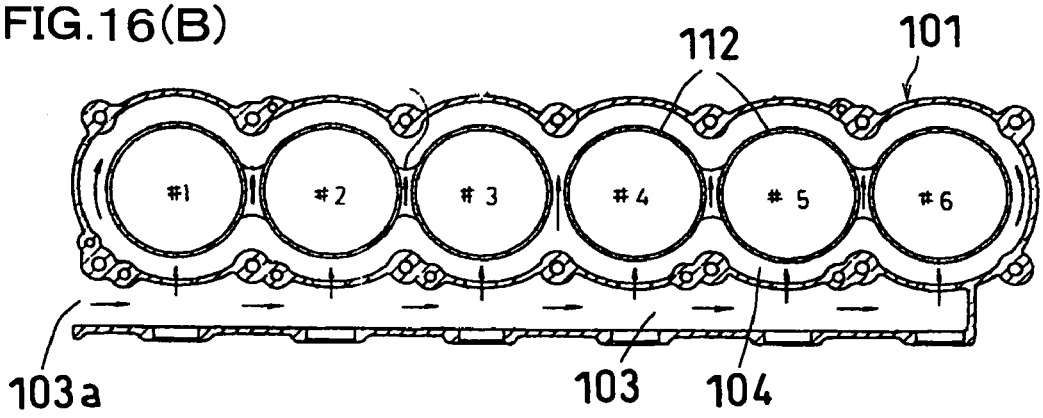
FIG. 16(B) is a sectional view taken along a line B—B in FIG. 16(A).

As shown in FIG. 12, an oil cooler 56 and the oil filter 2*b* are attached to the filter attaching seat 46 while they are overlaid one on another. The filter attaching seat 46 has an oil outlet 46*a* communicated with the rear end opening 2*d* of the side oil passage 2. As indicated by arrows in FIG. 14(B), the oil supplied from the oil pump 54 to the filter attaching seat 46 is fed to the side oil passage 2 through the oil cooler 56 and the oil filter 2*b* in the mentioned order as indicated by an arrow in FIG. 12. The side oil passage 2 has the rear end opening 2*d* provided in the rear end wall of the cylinder block 1. FIG. 15 also shows by arrows how the cooling water and the oil flow.

In this embodiment, as shown in FIG. 15, the cylinder block 1 has the rear end portion where the water pump 10 is arranged. The side water passage 3 has the rear end opening 3*b* which communicates the side water passage 3 with the water pump 10. The cylinder head 18 has a left and rear corner portion 28 opened at its lateral surface to provide the outlet 25*a* of the head jacket 25. Thus when compared with the first embodiment as shown in FIG. 8, the cooling water flows in a direction reversed in the front and rear direction in the side water passage 3 as well as in the head intake side water passage 26 and the head exhaust side water passage 27. However, the cooling water flows in the same direction as that of the first embodiment in the inter-cylinder transverse water passage 17 and the inter-port transverse water passage 21. In this second embodiment, the other components and functions are the same as those of the first embodiment. Therefore, in FIGS. 11 to 15, the elements identical to those of the first embodiment are designated by the identical references.

The engine of front-end pump arrangement type as the first embodiment and the engine of rear-end pump arrangement type as the second embodiment are produced alternatively in the following manner.

The cylinder block 1 is used as the common part.

In the case where the engine of front-end pump arrangement type as shown in FIGS. 1 and 2 is produced, the water pump 10 is arranged at the front end portion of the cylinder block 1 and is communicated with the side water passage 3 through the front end opening 3*a* of the side water passage 3. The rear end opening 3*b* of the side water passage 3 is sealed by the plug 44.

In the event that the engine of rear-end pump arrangement as shown in FIGS. 11 and 12 is produced, the water pump 10 is arranged at the rear end portion of the cylinder block 1 and is communicated with the side water passage 3 through the rear end opening 3*b* of the side water passage 3. The front end opening 3*a* of the side water passage 3 is sealed by the plug 47.

The filter attaching seat 46 is arranged at the front end portion of the cylinder block 1 in the engine of front-end pump arrangement type as shown in FIGS. 1 and 2 while it is disposed at the rear end portion of the cylinder block 1 in the engine of rear-end pump arrangement type as shown in FIGS. 11 and 12.

In the case of producing the engine of front-end pump arrangement type as shown in FIGS. 1 and 2, the front end opening 2*c* of the side oil passage 2 communicates the side oil passage 2 with the oil filter 2*b* through the filter attaching seat 46 at the front end portion of the side oil passage 2. The rear end opening 2*d* of the side oil passage 2 is sealed by the plug 45. And in the case of producing the engine of rear-end pump arrangement type as shown in FIGS. 11 and 12, the rear end opening 2*d* of the side oil passage 2 communicates the side oil passage 2 with the oil filter 2*b* through the filter attaching seat 46 at the rear end portion of the side oil passage 2. The front end opening 2*d* of the side oil passage 2 is sealed by the plug 48.

In this embodiment, the engine as shown in FIGS. 1 and 2 is used as an engine to be loaded on a tractor. More specifically, this engine in which the water pump 10 is arranged at the front one of the front and rear end portions of the cylinder block 1 where the timing transmission device 8 is disposed is employed as an engine to be loaded on a tractor with the water pump 10 to be disposed at an end of the cylinder block 1 away from the operator's seat.

What is claimed is:

1. A multi-cylinder engine comprising a cylinder block (1), when taking a longitudinal direction of the cylinder block (1) as a front and rear direction, the cylinder block (1) being provided with a consecutive side water passage (3) oriented in the front and rear direction and passing by each of cylinder walls (12), cooling water from a radiator being introduced into a cylinder jacket 4 laterally through the side water passage (3), wherein the side water passage (3) has front and rear end portions provided with front and rear openings (3*a*) and (3*b*) which communicate the side water passage (3) with a water pump (10), even if the water pump (10) is arranged at either of the front and rear end portions of the cylinder block (1), the opening of the side water passage (3) near the end portion where the water pump (10) is arranged, being able to communicate the side water passage (3) with the water pump (10)

the cylinder block (1) is provided with a consecutive side oil passage (2) oriented in the front and rear direction, and lubricating oil is introduced into a bearing portion of a crank shaft through the side oil passage (2), the side oil passage (2) having front and rear end portions provided with front and rear openings (2*c*), (2*d*) which communicate the side oil passage (2) with an oil filter (2*b*) through a filter attaching seat (46), even if the filter attaching seat (46) is arranged at either of the front and rear end portions of the cylinder block (1), the opening of the side oil passage (2) near the end portion where the filter attaching seat (46) is arranged, being able to communicate the side oil passage (2) with the oil filter (2*b*) through the filter attaching seat (46), and the filter attaching seat (46) being disposed at one of the front and rear end portions of the cylinder block (1) where the water pump (10) is arranged, the opening of the side oil passage (2) near the end portion where the filter attaching seat (46) is disposed, communicating the side oil passage (2) with the oil filter (2*b*) through the filter attaching seat (46), the other opening of the side oil passage (2) being sealed.

2. The multi-cylinder engine as set forth in claim 1, wherein a timing transmission device (8) is arranged at one of the front and rear end portions of the cylinder block on a side, which is taken as a front end portion, and a timing transmission case (43) has a front wall (43*a*) at which the filter attaching seat (46) is disposed, a case side bypassing oil passage (43*c*) being formed along the front wall (43*a*) and a peripheral wall (43*b*) of the timing transmission case (43), a block side bypassing passage (1*a*) being formed at the front end portion of the cylinder block (1), lubricating oil being fed to the side oil passage (2) while bypassing the timing transmission device (8), through the oil filter (2*b*), the case side bypassing oil passage (43*c*) and the block side bypassing passage (1*a*) in the mentioned order.

3. A multi-cylinder engine comprising a cylinder block (1), when taking a longitudinal direction of the cylinder block (1) as a front and rear direction, the cylinder block (1) being provided with a consecutive side water passage (3) oriented in the front and rear direction and passing by each of cylinder walls (12), cooling water from a radiator being introduced into a cylinder jacket 4 laterally through the side water passage (3), wherein the side water passage (3) has front and rear end portions provided with front and rear openings (3*a*) and (3*b*) which communicate the side water passage (3) with a water pump (10), and even if the water pump (10) is arranged at either of the front and rear end portions of the cylinder block (1), the opening of the side water passage (3) near the end portion where the water pump (10) is arranged, being able to communicate the side water passage (3) with the water pump (10) and when applying this invention to a vertical engine, the side water passage (3) has an outlet (5) opposed to a lower portion of the cylinder jacket (4).

4. The multi-cylinder engine as set forth in claim 3, wherein the cylinder block (1) has the front and rear end portions at either of which the water pump (10) is arranged, the opening of the side water passage (3) near the end portion where the water pump (10) is arranged, communicating the side water passage (3) with the water pump (10) and the other opening of the side water passage (3) being sealed.

5. The multi-cylinder engine as set forth in claim 3, wherein a timing transmission device (8) is disposed at one of the front and rear end portions of the cylinder block (1), where the water pump (10) is arranged.

6. The multi-cylinder engine as set forth in claim 5, where this engine is used as an engine to be loaded on a tractor, in which the water pump (10) is arranged at an end portion of the cylinder block (1), away from an operator's seat.

7. The multi-cylinder engine as set forth in claim 3, wherein a timing transmission device (8) is arranged at one of the front and rear end portions of the cylinder block (1), and the water pump (10) is disposed at the other end portion.

8. The multi-cylinder engine as set forth in claim 3, wherein the side water passage (3) which passes by all the cylinder walls (12) are provided with outlets (5) in plural number opposed to the cylinder jacket (4), these outlets (5) being disposed at longitudinally opposed end portions and a mid portion of the side water passage (3).

9. The multi-cylinder engine as set forth in claim 3, wherein the adjacent cylinder walls 12 and 12 are connected to each other by a connection wall (16), which is formed with an inter-cylinder transverse water passage (17) running widthwise of the cylinder block (1).

10. A multi-cylinder engine comprising a cylinder block (1), when taking a longitudinal direction of the cylinder block (1) as a front and rear direction, the cylinder block (1) being provided with a consecutive side water passage (3) oriented in the front and rear direction and passing by each of cylinder walls (12), cooling water from a radiator being introduced into a cylinder jacket 4 laterally through the side water passage (3), wherein the side water passage (3) has front and rear end portions provided with front and rear openings (3*a*) and (3*b*) which communicate the side water passage (3) with a water pump (10), and even if the water pump (10) is arranged at either of the front and rear end portions of the cylinder block (1), the opening of the side water passage (3) near the end portion where the water pump (10) is arranged, being able to communicate the side water passage (3) with the water pump (10) and when a cylinder is disposed vertically to form a vertical engine, and the side water passage (3) is arranged together with a pair of upper and lower shafts (6), (7) on one side of the cylinder block (1) in the vertical engine, the side water passage (3) and the pair of upper and lower shafts (6), (7) are disposed vertically along the cylinder jacket (4) and the cylinder walls (12).

11. A multi-cylinder engine comprising a cylinder block (1), when taking a longitudinal direction of the cylinder block (1) as a front and rear direction, the cylinder block (1) being provided with a consecutive side water passage (3) oriented in the front and rear direction and passing by each of cylinder walls (12), cooling water from a radiator being introduced into a cylinder jacket 4 laterally through the side water passage (3), wherein the side water passage (3) has front and rear end portions provided with front and rear openings (3*a*) and (3*b*) which communicate the side water passage (3) with a water pump (10), even if the water pump (10) is arranged at either of the front and rear end portions of the cylinder block (1), the opening of the side water passage (3) near the end portion where the water pump (10) is arranged, being able to communicate the side water passage (3) with the water pump (10), the side water passage (3) which passes by all the cylinder walls (12) are provided with outlets (5) in plural number opposed to the cylinder jacket (4), these outlets (5) being disposed at longitudinally opposed end portions and a mid portion of the side water passage (3), and a tappet guide hole (14) of a valve operating device is provided within a wall (13) between adjacent outlets (5), (5) of the side water passage (3).

12. The multi-cylinder engine as set forth in claim 8 or 11, wherein the side water passage (3) has each of the outlets (5) facing a laterally projecting end surface (15) of every cylinder wall (12).

13. A multi-cylinder engine comprising a cylinder block (1) when taking a longitudinal direction of the cylinder block (1) as a front and rear direction, the cylinder block (1) being provided with a consecutive side water passage (3) oriented in the front and rear direction and passing by each of cylinder walls (12), cooling water from a radiator being introduced into a cylinder jacket 4 laterally through the side water passage (3), wherein:

the side water passage (3) has front and rear end portions provided with front and rear openings (3*a*) and (3*b*) which communicate the side water passage (3) with a water pump (10), even if the water pump (10) is arranged at either of the front and rear end portions of the cylinder block (1), the opening of the side water passage (3) near the end portion where the water pump (10) is arranged, being able to communicate the side water passage (3) with the water pump (10), the adjacent cylinder walls (12 and 12) are connected to each other by a connection wall (16), which is formed with an inter-cylinder transverse water passage (17) running widthwise of the cylinder block (1), a head jacket (25) is provided within a cylinder head (18) and an inter-port transverse water passage (21) is formed widthwise of the cylinder head (18) between an intake port (19) of the cylinder head (18) and an exhaust port (20) thereof, and cooling water which has crossed the inter-cylinder transverse water passage (17) is made to return and cross the inter-port transverse water passage (21).

14. The multi-cylinder engine as set forth in claim 13, wherein a head intake side water passage (26) is formed on the side of an intake air distributing means (22) of the cylinder head (18) and a head exhaust side water passage (27) is formed on the side of an exhaust air converging means (23) thereof along a longitudinal direction of the cylinder head (18), the head intake side water passage (26) communicating with the head exhaust side water passage (27) through the inter-port transverse water passage (21), the cylinder head (18) having widthwise opposite sides, on one of which the side water passage (3) is present and the cylinder head (18) has a corner portion (28) formed with an outlet (25*a*) of the head jacket (25), the cooling water which has crossed the inter-cylinder transverse water passage (17) from the side water passage (3) to the opposite side floating up. to the water passage (26) opposite to the side water passage (3), of the head intake side water passage (26) and the head exhaust side water passage (27), the floating-up cooling water dividing into a plurality of inter-port transverse water passages (21) while passing through the water passage (26) toward the outlet (25*a*), the thus divided cooling water converging into the water passage (27) on the side of the side water passage (3) and passing through the water passage (27) toward the outlet (25*a*), the cooling water which has passed through both of the water passages (26) and (27) toward the outlet (25*a*) being made to converge and flow out of the outlet (25*a*) of the head jacket (25).

15. The multi-cylinder engine as set forth in claim 9 or 13, wherein the cooling water which has crossed the inter-port transverse water passage 21 flows from the intake air distributing means (22) on one side of the cylinder head (18) to the exhaust air converging means (23) on the other side thereof.

16. A method for alternatively producing multi-cylinder engines wherein a longitudinal direction of a cylinder block (1) is deemed as a front and rear direction, and one of the longitudinal direction is regarded as a front end portion while the other, a rear end portion, on the assumption that an engine which comprises a water pump (10) arranged at the front end portion of the cylinder block (1) is an engine of front-end pump arrangement type and another engine which comprises the water pump (10) arranged at the rear end portion is an engine of rear-end pump arrangement type, the cylinder block (1) being used as a common part, when alternatively producing the engine of front-end pump arrangement type and the engine of rear-end pump arrangement type, the cylinder block (1) used as the common part being provided with a consecutive side water passage (3) oriented in the front and rear direction and passing by every cylinder wall (12), cooling water from a radiator being made to enter a cylinder jacket (4) laterally through the side water passage (3), the side water passage (3) having front and rear end portions formed with front and rear end openings (3*a*), (3*b*) which communicate the side water passage (3) with the water pump (10), in the case where the engine of front-end pump arrangement type is produced, the method including the steps of arranging the water pump (10) at the front end portion of the cylinder block (1), making the front end opening (3*a*) of the side water passage (3) communicate with the water pump (10) and sealing the rear end opening (3*b*) of the side water passage (3), in the case where the engine of rear-end pump arrangement type is produced, the method including the steps of arranging the water pump (10) being arranged at the rear end portion of the cylinder block (1), making the rear end opening (3*b*) of the side water passage (3) communicate the side water passage (3) with the water pump (10) and sealing the front end opening (3*a*) of the side water passage (3), the engine of front-end pump arrangement type arranges a filter attaching seat (46) at the front end portion of the cylinder block (1) and the engine of rear-end pump arrangement type arranges the filter attaching seat (46) at the rear end portion thereof, the cylinder block (1) used as the common part being provided with a consecutive oil passage (2) which is oriented in the front and rear direction and introduces lubricating oil into a bearing portion (2*a*) of a crank shaft through the side oil passage (2), and the side oil passage (2) having front and rear end portions provided with front and rear end openings (2*c*), (2*d*) which communicate the side oil passage (2) with the oil filter (2*b*) through the filter attaching seat (46), in the case of producing the engine of front-end pump arrangement type, the method including the steps of making the front end opening (2*c*) of the side oil passage (2) communicate the side oil passage (2) with the oil filter (2*b*) through the filter attaching seat (46) at the front end portion and sealing the rear end opening (2*d*) of the side oil passage (2), in the case of producing the engine of rear-end pump arrangement type, the method including the steps of making the rear end opening (2*d*) of the side oil passage (2) communicate the side oil passage (2) with the oil filter (2*b*) through the filter attaching seat (46) at the rear end portion and sealing the front end opening (2*d*) of the side oil passage (2).

17. The method for alternatively producing multi-cylinder engines as set forth in claim 16, wherein the engine includes a timing transmission device (8) arranged at one of the front and rear end portions of the cylinder block (1) where the water pump (10) is disposed is employed as an engine to be loaded on a tractor with the water pump (10) to be arranged at an end portion of the cylinder block (1) away from an operator's seat.

* * * * *